US009243634B2

(12) United States Patent
Hayashi et al.

(10) Patent No.: US 9,243,634 B2
(45) Date of Patent: Jan. 26, 2016

(54) COMPRESSOR WITH SLIDING MEMBER RESIN LAYER

(75) Inventors: Takeo Hayashi, Kusatsu (JP); Yuuichi Yamamoto, Kusatsu (JP); Masahide Higuchi, Kusatsu (JP); Chihiro Endou, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 131 days.

(21) Appl. No.: 13/996,767

(22) PCT Filed: Dec. 19, 2011

(86) PCT No.: PCT/JP2011/079323

§ 371 (c)(1),
(2), (4) Date: Jun. 21, 2013

(87) PCT Pub. No.: WO2012/086577

PCT Pub. Date: Jun. 28, 2012

(65) Prior Publication Data

US 2013/0280116 A1 Oct. 24, 2013

(30) Foreign Application Priority Data

Dec. 22, 2010 (JP) ..... 2010-286352
Dec. 27, 2010 (JP) ..... 2010-289813

(51) Int. Cl.
*F04C 18/00* (2006.01)
*F04C 18/02* (2006.01)
(Continued)

(52) U.S. Cl.
CPC ..... *F04C 18/00* (2013.01); *F01C 21/08* (2013.01); *F04B 39/126* (2013.01); *F04B 53/14* (2013.01); *F04C 18/0215* (2013.01); *F04C 18/322* (2013.01); *F04C 18/356* (2013.01); *F04C 29/02* (2013.01); *F04C 23/008* (2013.01);
(Continued)

(58) Field of Classification Search
CPC ..... F01C 21/08; F04B 39/126; F04B 53/14; F04C 18/04; F04C 18/322; F04C 18/356; F04C 2230/91
See application file for complete search history.

(56) References Cited

U.S. PATENT DOCUMENTS 4,139,576 A 2/1979 Yoshimura et al.
4,177,320 A 12/1979 Yoshimura et al.
(Continued)

FOREIGN PATENT DOCUMENTS

CN 1796785 A 7/2006
CN 1910369 A 2/2007
(Continued)

OTHER PUBLICATIONS

International Preliminary Report on Patentability of corresponding International Application No. PCT/JP2011/079323, mailed date on Jul. 2, 2013.
(Continued)

*Primary Examiner* — Mary A Davis
(74) *Attorney, Agent, or Firm* — Global IP Counselors

(57) ABSTRACT

A compressor includes sliding members arranged to slide relative to each other when compressing a refrigerant. At least one of the sliding members has a resin layer that is formed on the whole area or a portion of at least one sliding surface. The resin layer has an arithmetic mean surface roughness (Ra) of 0.3 or more, or the whole area or a portion of an area opposed to the resin layer is entirely or partially harder than the resin layer and has an arithmetic mean surface roughness (Ra) of 0.3 or more.

14 Claims, 27 Drawing Sheets

(51) Int. Cl.

| | |
|---|---|
| ***F04C 18/356*** | (2006.01) |
| ***F04C 29/02*** | (2006.01) |
| ***F01C 21/00*** | (2006.01) |
| ***F04B 39/12*** | (2006.01) |
| ***F01C 21/08*** | (2006.01) |
| ***F04B 53/14*** | (2006.01) |
| ***F04C 18/32*** | (2006.01) |
| *F04C 23/00* | (2006.01) |

(52) U.S. Cl.
CPC ..... *F04C2230/91* (2013.01); *F05C 2251/10* (2013.01); *F05C 2251/14* (2013.01); *F05C 2253/20* (2013.01)

(56) References Cited

U.S. PATENT DOCUMENTS

| | | | | |
|---|---|---|---|---|
| 6,688,867 | B2 | 2/2004 | Suman et al. | |
| 2002/0141894 | A1 | 10/2002 | Kirtley et al. | |
| 2003/0111511 | A1 | 6/2003 | Kanayama et al. | |
| 2006/0140792 | A1 | 6/2006 | Tsuchiya et al. | |
| 2007/0225177 | A1 | 9/2007 | Murase et al. | |
| 2008/0025861 | A1 | 1/2008 | Okawa et al. | |
| 2008/0240961 | A1 | 10/2008 | Doi et al. | |
| 2010/0095837 | A1* | 4/2010 | Suman | 92/153 |
| 2013/0174724 | A1* | 7/2013 | Tanigawa et al. | 92/57 |
| 2013/0280117 | A1 | 10/2013 | Hayashi et al. | |

FOREIGN PATENT DOCUMENTS

| | | | |
|---|---|---|---|
| JP | 53-73222 | A | 6/1978 |
| JP | 62-253987 | A | 11/1987 |
| JP | 62-253987 | A | 11/1987 |
| JP | 2-218883 | A | 8/1990 |
| JP | 6-101662 | A | 4/1994 |
| JP | 6-101662 | A | 4/1994 |
| JP | 9-88855 | A | 3/1997 |
| JP | 9-88855 | A | 3/1997 |
| JP | 2002-256371 | A | 9/2002 |
| JP | 2002-256371 | A | 9/2002 |
| JP | 2003-254262 | A | 9/2003 |
| JP | 2003-254262 | A | 9/2003 |
| JP | 2005-337129 | A | 12/2005 |
| JP | 2005-337129 | A | 12/2005 |
| JP | 2006-275280 | A | 10/2006 |
| JP | 2006-275280 | A | 10/2006 |
| JP | 2006275280 | A * | 10/2006 |
| JP | 2007-204602 | A | 8/2007 |
| JP | 2007-204602 | A | 8/2007 |
| JP | 2007-225013 | A | 9/2007 |
| JP | 2007-225013 | A | 9/2007 |
| WO | 02/075172 | A1 | 9/2002 |

OTHER PUBLICATIONS

International Preliminary Report on Patentability of related International Application No. PCT/JP2011/079359, mailed date on Jul. 2, 2013.

European Search Report of corresponding EP Application No. 11 85 0215.2 dated Jul. 22, 2014.

European Search Report of related EP Application No. 11 85 3218.3 dated Jul. 31, 2014.

International Search Report of corresponding PCT Application No. PCT/JP2011/079323, mailed Mar. 27, 2012.

International Search Report of related case PCT Application No. PCT/JP2011/0793359, mailed Feb. 21, 2012.

International Search Report of corresponding PCT Application No. PCT/JP2011/079323 mailed Mar. 27, 2012.

International Search Report of related case PCT Application No. PCT/JP2011/0793359 mailed Feb. 21, 2012.

Pending U.S. Appl. No. 13/997,738 (Hayashi et al.) filed on Jun. 25, 2013.

* cited by examiner

0° (UPPER DEAD CENTER)

90°

180° (LOWER DEAD CENTER)

270°

0° (UPPER DEAD CENTER)

90°

180° (LOWER DEAD CENTER)

270°

COMPRESSOR WITH SLIDING MEMBER RESIN LAYER

CROSS-REFERENCE TO RELATED APPLICATIONS

This U.S. National stage application claims priority under 35 U.S.C. §119(a) to Japanese Patent Application Nos. 2010-286352, filed in Japan on Dec. 22, 2010, and 2010-289813, filed in Japan on Dec. 27, 2010, the entire contents of which are hereby incorporated herein by reference.

TECHNICAL FIELD

The present invention relates to a compressor that compresses a refrigerant.

BACKGROUND ART

As a compressor, there has traditionally been a rotary compressor including a cylinder and a roller disposed inside the cylinder. In this rotary compressor, the roller is attached to a shaft that eccentrically rotates, and moves along the inner circumference surface of the cylinder with the rotation of the shaft.

In the rotary compressor, there is a minute gap between an end surface of a roller and an end plate member disposed to oppose this end surface, and between the outer circumference surface of the roller and the inner circumference surface of a cylinder, for the purpose of preventing seizure caused by sliding. The size of the gap is preferably as small as possible so as to prevent leakage of a refrigerant or lubricating oil. Even with such a gap however, the gap may close up and seizure may take place due to sliding, if the amount of thermal expansion of the roller is greater than that of the cylinder. Such a case may take place for example when the compressor is activated at a high speed.

Further, as a compressor other than the rotary compressor, there is a scroll compressor including a fixed scroll having a fixed-side wrap having a spiral shape, and a moveable scroll having a moveable-side wrap having a spiral shape that engages with the fixed-side wrap. In this scroll compressor, the moveable scroll is mounted to a shaft that eccentrically rotates, and circles with rotation of the moveable scroll.

In this scroll compressor, there is a small gap between an end surface of the wrap and a surface facing this end surface, and between a side surface of the wrap and a side surface (including a side surface of the other wrap) facing this side surface, for the purpose of preventing seizure caused by sliding. However, the gap closes up and seizure takes place, depending on the operation conditions.

To address the issue of seizure in the compressors, for example, Japanese Unexamined Patent Publication No. 275280/2006 (Tokukai 2006-275280) suggests a use of resin coating to improve the slidability. This allows prevention of seizure without enlarging the gap.

SUMMARY

Technical Problem

However, in addition to the above described problem. of seizure, sliding movement also causes a problem that the efficiency of the compressor may deteriorated due to the frictional loss. The compressor of Japanese Unexamined Patent Publication No. 275280/2006 (Tokukai 2006-275280), with the resin coating, is able to prevent the seizure due to sliding; however, leaves the problem of deterioration in the efficiency of the compressor due to the frictional loss. Further, a resin coating layer swells by absorbing the refrigerant or the lubricating oil. Therefore, there is a possibility that the gap may close up not only in cases of activating the compressor at high speeds, hut also in cases of ordinary operations.

In view of the above, it is an object of the present invention to provide a compressor in which frictional loss caused by the surface of the resin layer sliding in contact with a member opposing the surface is reduced.

Solution to Problem

To achieve the above object, a compressor related to a first aspect of the present, invention is such that a resin layer is formed on a whole area or a portion of sliding surface of one of sliding members sliding when compressing a refrigerant; and an arithmetic mean surface roughness Ra of the resin layer is 0.3 or higher, or an area opposing to the resin layer is entirely or partially harder than the resin layer and has an arithmetic mean surface roughness Ra of 0.3 or higher.

This compressor, with the slidability of the resin layer, prevents seizure when the surface of the resin layer slides in contact with another member.

Further, when the arithmetic mean surface roughness Ra of the resin layer is 0.3 or higher, the surface roughness of the resin layer is relatively rough. Therefore, when the surface of the resin layer slides in contact with the other member, the minute protrusions constituting the surface roughness of the resin layer are easily worn out, or if not, at least easily deformed. This reduces the surface pressure between the contact surfaces, thus reducing the frictional loss, and restrains deterioration in the efficiency of the compressor.

Further, in cases where the whole area or a part of the area opposing to the resin layer is harder than the resin layer and has an arithmetic mean surface roughness Ra of 0.3 or higher, the surface of the resin layer is worn out to the extent that there is almost no work of the surface pressure while the surface of the resin layer slides in contact with the other member. The reduction of the surface pressure between the contact surfaces reduces the frictional loss, and restrains deterioration of the efficiency of the compressor.

A second aspect of the present invention is the compressor of the first aspect of the present invention, including a cylinder having a compression chamber and a blade housing in communication with the compression chamber; a first end plate member and a second end plate member disposed on both ends of the cylinder relative to an axial direction; and a piston disposed in the compression chamber and inside the blade housing, wherein the piston includes an annular roller disposed in the compression chamber, a blade extending from the outer circumference surface of the roller and disposed in the blade housing so as to be able to move forward and backward; wherein the resin layer whose arithmetic mean surface roughness Ra is 0.3 or higher is formed on a whole area or a portion of at least one of: (1) an axial direction end surface of the piston; (2) a surface of the first end plate member, opposing to the axial direction end surface of the piston; (3) a surface of the second end plate member, opposing to the axial direction end surface of the piston; (4) an outer circumference surface of the roller; and (5) an inner circumference surface of the compression chamber.

In this compressor, when the at least one of the axial direction end surfaces of the piston and the corresponding one of the end plate members slide, or when the outer circumference surface of the roller and the inner circumference surface of the compression chamber slide, the resin layer prevents the seizure and reduces the frictional loss.

A third aspect of the present invention is the compressor of the first aspect, including a cylinder having a compression chamber and a blade housing in communication with the compression chamber; a first end plate member and a second end plate member disposed on both ends of the cylinder relative to an axial direction; and a piston disposed in the compression chamber and inside the blade housing, wherein the piston includes an annular roller disposed in the compression chamber, a blade extending from the outer circumference surface of the roller and disposed in the blade housing so as to be able to move forward and backward; wherein the resin layer whose arithmetic mean surface roughness Ra is 0.3 or higher is formed on a whole area or a portion of at least one of: (1) an axial direction end surface of the piston; (2) a surface of the first end plate member, opposing to the axial direction end surface of the piston; (3) a surface of the second end plate member, opposing to the axial direction end surface of the piston; (4) an outer circumference surface of the roller; and (5) an inner circumference surface of the compression chamber.

In this compressor, when the at least one of the axial direction end surfaces of the roller or the vane and the corresponding one of the end plate members slide, or when the outer circumference surface of the roller and the inner circumference surface of the compression chamber slide, the resin layer prevents seizure and reduces the frictional loss.

A fourth aspect of the present invention is the compressor of the first aspect, including a first scroll having a recess and a first wrap in a spiral shape, which projects from, a bottom surface of the recess; and a second scroll having a flat plate section and a second wrap in a spiral shape, which projects from the flat plate section, wherein the first scroll and the second scroll are closely located to each other so that the bottom surface of the recess and the flat plate section oppose to each other, and a side surface of the first wrap and a side surface of the second wrap oppose to each other, and wherein the resin layer whose arithmetic mean surface roughness Ra is 0.3 or higher is formed on a whole area or a portion of at least one of: (1) an end surface of the first wrap; (2) a surface opposing to the end surface of the first wrap on the flat plate section; (3) an end surface of the second wrap; (4) a surface opposing to the end surface of the second wrap on the bottom surface of the recess; (5) the side surface of the first wrap; (6) the side surface of the second wrap; and (7) an inner circumference surface of the recess.

In this compressor, when the end surface of the first, wrap and the flat plate section of the second scroll slide, when the end surface of the second wrap and the recess of the first scroll slide, or when the side surface of the first wrap or the inner circumference surface of the recess and the side surface of the second wrap slide, the resin layer prevents seizure and reduces the frictional loss.

A fifth aspect of the present invention is the compressor of any one of the first to fourth aspects, adapted, so that the surface of the resin layer whose arithmetic mean surface roughness Ra is 0.3 or higher has a kurtosis Rku of its roughness curves of 3 or higher.

In this compressor, the protrusions constituting the surface roughness of the resin layer each have a sharp leading edge. Therefore, when, the resin layer contacts the other member, the protrusions are easily worn out or deformed. Thus, the surface pressure between contact surfaces is promptly and reliably reduced.

A sixth aspect of the present invention is the compressor of any one of the first to fifth aspects, adapted so that the surface of the resin layer whose arithmetic mean surface roughness Ra is 0.3 or higher has a skewness Rsk of its roughness curves of more than 0, and a maximum height roughness Rz is greater than an average length RSm of roughness curve elements.

In this compressor, the protrusions constituting the surface roughness of the resin layer each have a tapered shape, and its height is greater than its width. Therefore, when the resin layer contacts the other member, the protrusions are easily worn out or deformed. Thus, the surface pressure between the contact surfaces is promptly and reliably reduced.

A seventh aspect of the present invention is the compressor of any one of the first to sixth aspects, adapted so that recesses and protrusions constituting the surface roughness of the resin layer whose arithmetic mean surface roughness Ra is 0.3 or higher are formed only on the resin layer.

In this compressor, the protrusions constituting the surface roughness of the resin layer is made only by a resin composition. Therefore, the protrusions are easily deformed.

An eighth aspect of the present invention is the compressor of any one of the first to seventh aspects, adapted so that the surface of the base on which the resin layer whose arithmetic mean surface roughness Ra is 0.3 or higher is formed has an arithmetic mean surface roughness Ra of 0.3 or higher.

In this compressor, the minute recesses and protrusions are formed on the surface of the base. This yields a favorable adhesiveness between the resin layer and the base, and the resin layer is hardly peeled off.

A ninth aspect of the present invention is the compressor of the eighth aspect of the present invention, adapted so that the recesses and protrusions constituting the surface roughness of the resin layer are formed along recesses and protrusions formed on the surface of the base.

In this compressor, the resin layer is formed simply by forming a resin coating on the base whose surface has recesses and protrusions. Therefore, it is not necessary to conduct a process for forming the recesses and protrusions on the resin layer.

A tenth aspect of the present invention is the compressor of any one of the first to ninth aspects, adapted so that the hardness of the resin layer whose arithmetic mean surface roughness Ra is 0.3 or higher is less than a surface opposing to the resin layer.

In this compressor, the surface of the resin layer is easily worn out because the hardness of the resin layer is less than that of the opposing surface. Thus, the surface pressure between the surfaces in contact is promptly and reliably reduced.

A eleventh aspect of the present invention is a compressor of the first aspect of the present invention, including a cylinder having a compression chamber and a blade housing in communication with the compression chamber; two end plate members disposed on both sides of the cylinder relative to the axial direction; and a piston disposed in the compression chamber and inside the blade housing, wherein the piston includes an annular roller disposed in the compression chamber, a blade extending from the outer circumference surface of the roller and disposed in the blade housing so as to be able to move forward and backward; wherein the resin layer is formed on a whole area or a portion of at least on of: at least one of axial direction end surfaces of the piston; and a surface of at least one of the end plate members opposing to the at least one of axial direction end surface of the piston; and of the at least one of the axial direction end surfaces of the piston and the surface of the at least one of end plate members opposing to the at least one of axial direction end surfaces of the piston, an area facing the resin layer is entirely or partially harder than the resin layer, and has an arithmetic mean, surface roughness Ra of 0.3 or higher.

In this compressor, when the at least one of the axial direction end surfaces of the piston and the corresponding one of the end plate members slide, the resin layer prevents seizure and reduces the frictional loss.

A twelfth aspect of the present invention is a compressor of the first aspect of the present invention, including: a cylinder having a compression chamber and a vane storage unit, in communication with the compression chamber; two end plate members disposed on both sides of the cylinder relative to the axial, direction; and an annular roller disposed inside the compression chamber; and a vane having a leading end pressed against an outer circumference surface of the roller, which is disposed in the vane storage unit so as to be able to move forward and backward, wherein the resin layer is formed on a whole area or a portion of at least one of: at least one of axial direction end surfaces of the roller; at least one of axial direction end surfaces of the vane; a surface of at least one of the end plate members, opposing to the at least one of the axial direction end surfaces of the roller or the at least one of the axial direction end surfaces of the vane, and of the at least one of the axial direction end surfaces of the roller or the at least one of the axial direction end surfaces of the vane, and the surface of the at least one of end plate members opposing to the at least one of the axial direction end surfaces of the roller or the at least one of the axial direction end surfaces of the vane, an area opposing to the resin layer is entirely or partially harder than the resin layer, and has an arithmetic mean surface roughness Ra of 0.3 or higher.

In this compressor, when the at least one of the axial direction end surfaces of the roller or the vane and the at least one of the end plate members slide, the resin layer prevents seizure and reduces the frictional loss.

Advantageous Effects of Invention

As described hereinabove, the present invention brings about the following effects.

The first aspect of the present invention, with the slidability of the resin layer, prevents seizure when the surface of the resin layer slides in contact with another member. Further, when the arithmetic mean surface roughness Ra of the resin layer is 0.3 or higher, the surface roughness of the resin layer is relatively rough. Therefore, when the surface of the resin layer slides in contact with the other member, the minute protrusions constituting the surface roughness of the resin layer is easily worn out, or if not, at least, easily deformed. This reduces the surface pressure between the contact surfaces, thus reducing the frictional loss, and restrains deterioration in the efficiency of the compressor.

Further, in cases where the whole area or a part of the area opposing to the resin layer is harder than the resin layer and has an arithmetic mean surface roughness Ra of 0.3 or higher, the surface of the resin layer is worn out to the extent that there is almost no work of the surface pressure while the surface of the resin layer slides in contact with the other member. The reduction of the surface pressure between the contact surfaces reduces the frictional loss, and restrains deterioration of the efficiency of the compressor.

In the second aspect of the present invention, when the at least one of the axial direction end surfaces of the piston and corresponding one of the end plate members slide, or when the outer circumference surface of the roller and the inner circumference surface of the compression chamber slide, the resin layer prevents the seizure and reduces the frictional loss.

In the third aspect of the present invention, when the at least one of the axial direction end surfaces of the roller or the vane and the corresponding one of the end plate members slide, or when the outer circumference surface of the roller and the inner circumference surface of the compression chamber slide, the resin layer prevents seizure and reduces the frictional loss.

In the fourth aspect of the present invention, when the end surface of the first wrap and the flat plate section of the second scroll slide, when the end surface of the second wrap and the recess of the first scroll slide, or when the side surface of the first wrap or the inner circumference surface of the recess and the side surface of the second wrap slide, the resin layer prevents seizure and reduces the frictional loss.

In the fifth aspect of the present invention, the protrusions constituting the surface roughness of the resin layer each have a sharp leading edge. Therefore, when the resin layer contacts the other member, the protrusions are easily worn out or deformed. Thus, the surface pressure between the contact surfaces is promptly and reliably reduced.

In the sixth aspect of the present invention, the protrusions constituting the surface roughness of the resin layer each have a tapered shape, and its height is greater than its width. Therefore, when the resin layer contacts the other member, the protrusions are easily worn out or deformed. Thus, the surface pressure between the contact surfaces is promptly and reliably reduced.

In the seventh aspect of the present invention, the protrusions constituting the surface roughness of the resin layer is made only by a resin composition. Therefore, the protrusions are easily deformed.

In the eighth aspect of the present invention, the minute recesses and protrusions are formed on the surface of the base. This yields a favorable adhesiveness between the resin layer and the base, and the resin layer is hardly peeled off.

In the ninth aspect of the present invention, the resin layer is formed simply by forming a resin coating on the base whose surface has recesses and protrusions. Therefore, it is not necessary to conduct a process for forming the recesses and protrusions on the resin layer.

In the tenth aspect of the present, invention, the surface of the resin layer is easily worn out because the hardness of the resin layer is less than that of the opposing surface. Thus, the surface pressure between the contact surfaces is promptly and reliably reduced.

In the eleventh aspect of the present invention, when the at least one of the axial direction end surfaces of the piston and the corresponding one of the end plate members slide, the resin layer prevents seizure and reduces the frictional loss.

In the twelfth aspect of the present invention, when the at least one of the axial direction end surfaces of the roller or the vane and the at least one of the end plate members slide, the resin layer prevents seizure and reduces the frictional loss.

DESCRIPTION OF EMBODIMENTS

<First Embodiment>

The following describes a first embodiment of the present invention.

The present embodiment is an exemplary application of the present invention to a mono cylinder rotary compressor.

Figure 1:
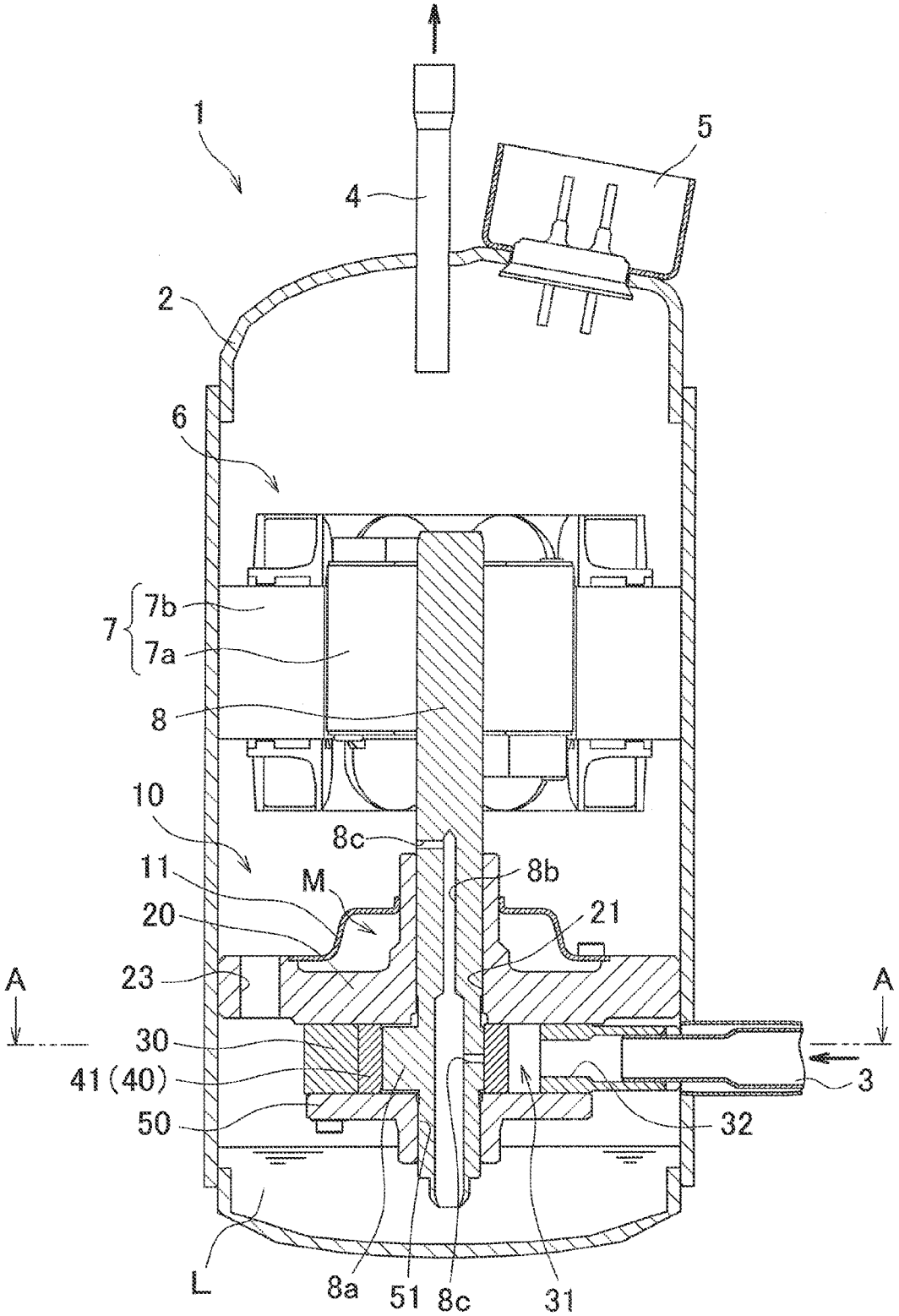
FIG. 1 is a schematic cross sectional view of a compressor related to a first embodiment of the present invention.
Figure 2A:
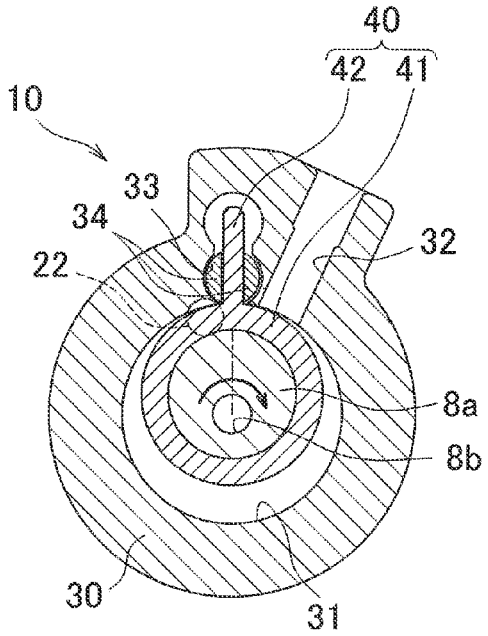
FIG. 2 is a cross sectional view taken along the line A-A in FIG. 1, and shows an operation of the piston in a cylinder.
Figure 2B:
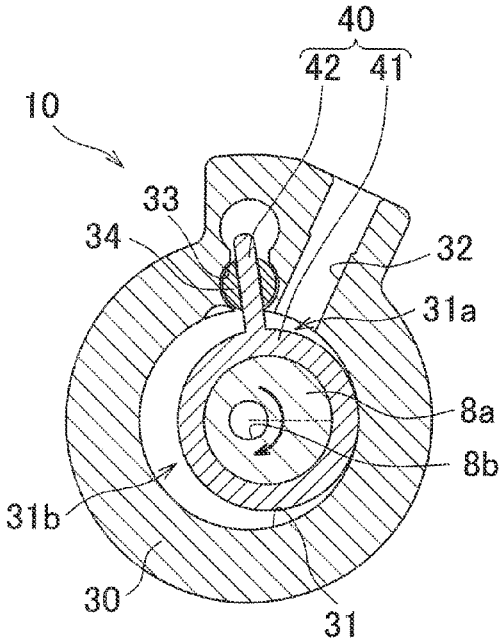
Figure 2C:
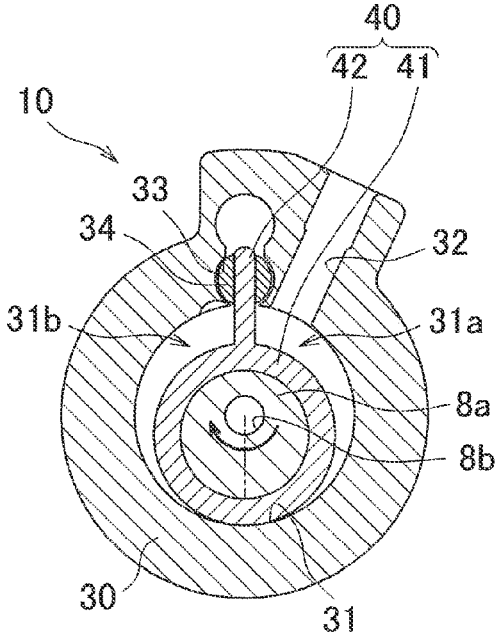
Figure 2D:
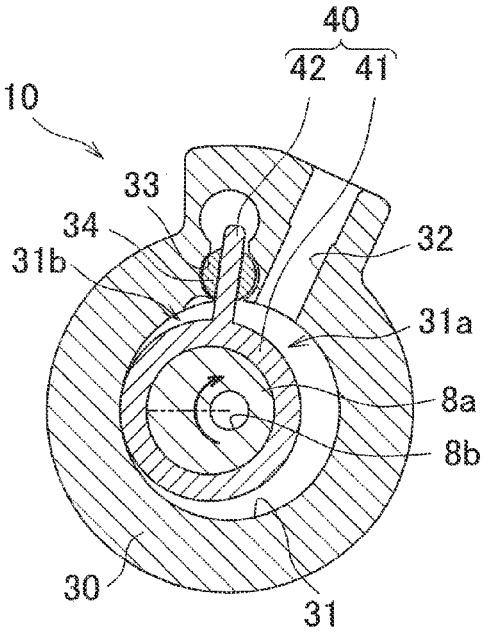

As shown in FIG. 1, a compressor 1 of the present embodiment includes a closed casing 2 and a compressing structure 10 and a drive mechanism 6 disposed in the closed casing 2. Note that hatching for indicating the cross section of the drive mechanism 6 is omitted in FIG. 1. This compressor 1, which is for use in a refrigerating cycle such as an air conditioner, compresses a refrigerant (CO2 in the present embodiment) introduced from the inlet pipe fitting 3 and outputs the compressed refrigerant from the outlet, pipe fitting 4. The following description of the compressor 1 assumes the up/down direction of FIG. 1 is the vertical direction.

The closed casing 2 is a cylindrical container with its both ends closed. On top of the casing 2 is provided an outlet pipe fitting 4 for outputting the compressed refrigerant, a terminal 5 for supplying currency to a later-mentioned coil of a stator 7*b* of the drive mechanism 6. Note that FIG. 1 omits illustration of wiring connecting the coil and the terminal 5. Further, on a side portion of the closed casing 2 is provided an inlet pipe fitting 3 for introducing the refrigerant to the compressor 1. Further, below the closed casing 2 is stored a lubricating oil L which smoothens the operation of a slide portion of the compressing structure 10. In the closed casing 2, the drive mechanism 6 and the compressing structure 10 are disposed up and down, respectively.

The drive mechanism 6 is provided for driving the compressing structure 10, and includes a motor 7 serving as a drive source, and a shaft 8 attached to the motor 7.

The motor 7 includes a substantially annular stator 7*b* which is fixed to the circumference surface of the closed casing 2, and a rotor 7*a* disposed on the radially inner side of the stator 7*b* with an air gap therebetween. The rotor 7*a* has a magnet (not shown), and the stator 7*b* has a coil. The motor 7 rotates the rotor 7*a* using the electromagnetic force generated by supplying of the currency to the coil. Further, the outer circumference surface of the stator 7*b* is not entirely in close contact with the inner circumference surface of the closed casing 2, i.e., a plurality of recesses (not shown) extending in the vertical direction and communicating the spaces above and below the motor 7 are provided along the outer circumference surface of the stator 7*b*.

The shaft 8 is for transmitting the drive force of the motor 7 to the compressing structure 10, and is fixed to the inner circumference surface of the rotor 7*a* to rotate integrally with the rotor 7*a*. Further, the shaft 8 has an eccentric portion 8*a* in a position serve as a later-mentioned compression chamber 31. The eccentric portion 8*a* is formed in a cylindrical manner, and its shaft center is deviated from the rotation center of the shaft 8. To this eccentric portion 8*a* is mounted a later-mentioned roller 41 of the compressing structure 10.

Further, inside a substantially lower half of the shaft 8 is formed a lubrication path 8*b* extended in the vertical direction. At the lower end portion of the lubrication path 8*b* is inserted a pump member (not shown) having a helical blade shape, which draws the lubricating oil L into the lubrication path 8*b* with rotation of the shaft 8. Further, the shaft 8 has a plurality of outlet holes 8*c* for outputting the lubricating oil L inside the lubrication path 8*b* to the outside the shaft 8.

The compressing structure 10 includes a front head (first end plate member) 20 fixed to the inner circumference surface of the closed casing 2, a muffler 11 disposed above the front head 20, a cylinder 30 disposed below the front head 20, a piston 40 disposed inside the cylinder 30, and a rear head (second end plate member) 50 disposed below the cylinder 30. As shown in FIG. 2, the cylinder 30 is a substantially annular member with a compression chamber 31 formed at its center portion. This is detailed later. The cylinder 30 is fixed to the lower side of the front head 20 by using a bolt, along with the rear head 50. Note that FIG. 2 omits illustration of a bolt hole which is formed on the cylinder 30.

Figure 3:
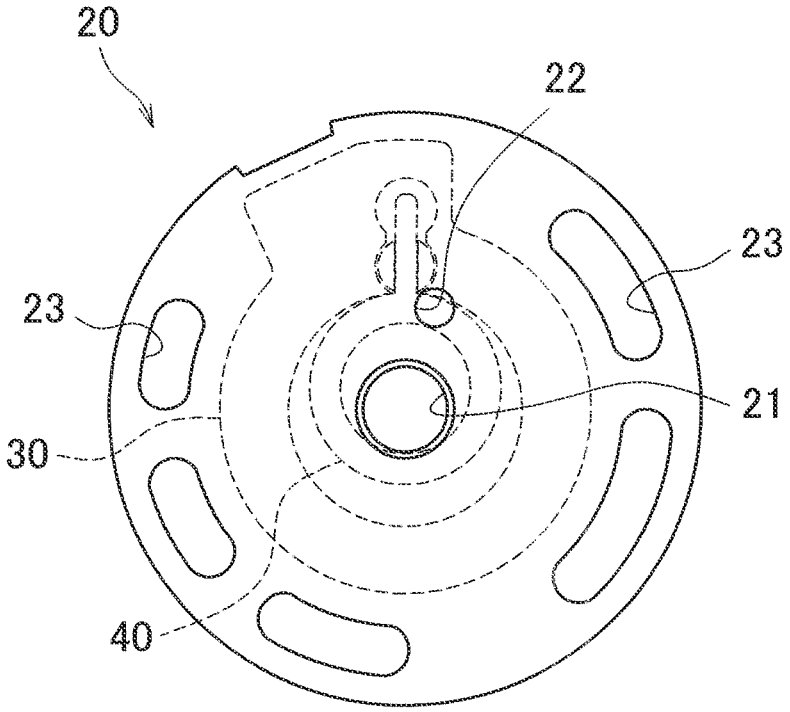
FIG. 3 is a diagram providing a bottom view of the front head in the compressor shown in FIG. 1.

As shown in FIG. 1 and FIG. 3, the front head 20 is a substantially annular member, and its center portion has a bearing hole 21 into which the shaft 8 is rotatably inserted. The outer circumference surface of the front head 20 is fixed to the inner circumference surface of the closed casing 2 by means of spot welding or the like. The under surface of the front head 20 closes the upper end of the compression chamber 31 of the cylinder 30. On the front head 20 is formed a discharge hole 22 which ejects a refrigerant compressed in the compression chamber 31. The discharge hole 22, when viewed in the vertical direction, is formed nearby a later-mentioned blade housing 33 in the cylinder 30. On the top surface or the front head 20 is attached a valve structure which opens and closes the discharge hole 22 according to the pressure inside the compression chamber 31. Illustration of this however is omitted. Further, at a portion of the front head 20 radially outside of the cylinder 30, a plurality of oil-returning holes 23 are formed and aligned in the circumferential direction. The front head 20 is made of a metal material and is formed by means of sintering of metal powder, casting, cutting, or the like. The surface of the front head 20 is polished.

The rear head 50 is a substantially annular member, and its center portion has a bearing hole 51 into which the shaft 8 is rotatably inserted. The rear head 50 closes the lower end of the compression chamber 31 of the cylinder 30. The rear head 50 is made of a metal material and is formed, by means of sintering of metal powder, casting, cutting, or the like. The surface of the rear head 50 is polished.

The muffler 11 is provided, for the purpose of reducing the noise generated, at the time of ejecting the refrigerant from the discharge hole 22 of the front head 20. The muffler 11 is attached to the top surface of the front head 20 by using a bolt, and forms a muffler space M between the front head 20 and the muffler 11. Further, the muffler 11 has a muffler discharge hole for discharging the refrigerant in the muffler space M.

As shown in FIG. 1 and FIG. 2, in the cylinder 30 are formed, the above-mentioned compression chamber 31, a draw-in hole 32 for introducing the refrigerant inside the compression chamber 31, and a blade housing 33. Note that FIG. 2 (*a*) is a cross sectional view taken along the line A-A of FIG. 1, and the discharge hole 22 on the front head 20 is not supposed to be shown. However, for the sake of convenience, the discharge hole 22 is shown in the figure. The cylinder 30 is made of a metal material, and is made by sintering of metal powder, casting, or by cutting.

The draw-in hole 32 extends in a radial direction of the cylinder 30, and a leading end of the inlet pipe fitting 3 is inserted into the end portion (the end portion opposite to the compression chamber 31) of the draw-in hole 32.

The blade housing 33 penetrates the cylinder 30 in the vertical direction, and is in communication with the compression chamber 31. The blade housing 33 extends in a radial direction of the compression chamber 31. The blade housing 33, when viewed in the vertical direction, is formed, between the draw-in hole 32 and the discharge hole 22 of the front head 20. Inside the blade housing 33 is a pair of bushes 34. The pair of bushes 34 each has a shape such that a substantially cylindrical member is cut in half. Between the pair of bushes 34 is disposed a blade 42. The pair of bushes 34 is capable of moving within the blade housing 33, in the circumferential direction, while the blade 42 disposed therebetween.

Figure 4:
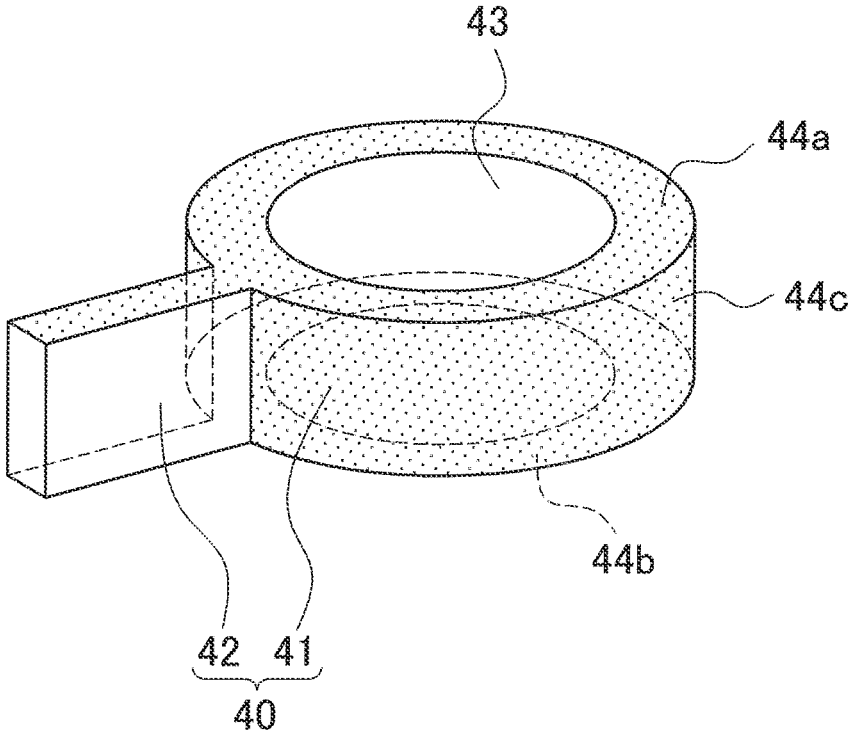
FIG. 4 is a perspective diagram of the piston of the compressor shown in FIG 1.

As shown in FIG. 4, the piston 40 has an annular roller 41, and a blade 42 extended radially outward from the outer circumference surface of the roller 41. As shown in FIG. 2, the roller 41 is disposed in the compression chamber 31, and is mounted to the outer circumference surface of the eccentric portion 8*a* so that relative rotation is possible. The blade 42 is disposed between the pair of bushes 34 in the blade housing 33 and is capable of moving forward and backward.

As shown in FIG. 2 (*b*) to FIG. 2 (*d*), the space formed between the outer circumference surface of the roller 41 and the circumferential wall of the compression chamber 31, while the blade 42 is relatively out of the compression chamber 31 of the blade housing 33, is divided into a low pressure chamber 31*a* and a high pressure chamber 31*b* by the blade 42.

Figure 5A:
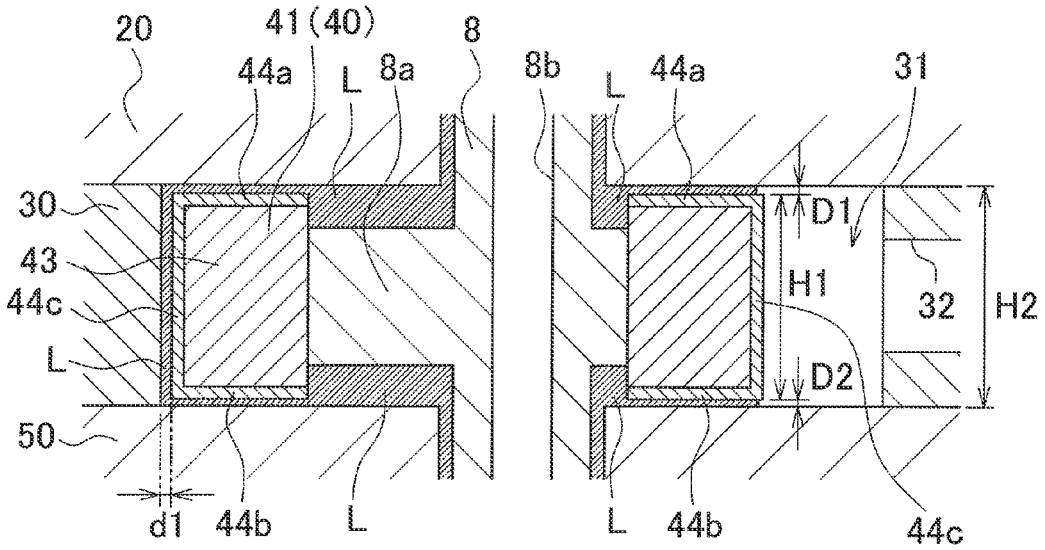
FIG. 5 is a schematic diagram providing partially enlarged views of FIG. 1, wherein FIG. 5(*a*) shows a state in which the resin layer is not swollen, and FIG. 5(*b*) shows a state where the resin layer is swollen.
Figure 5B:
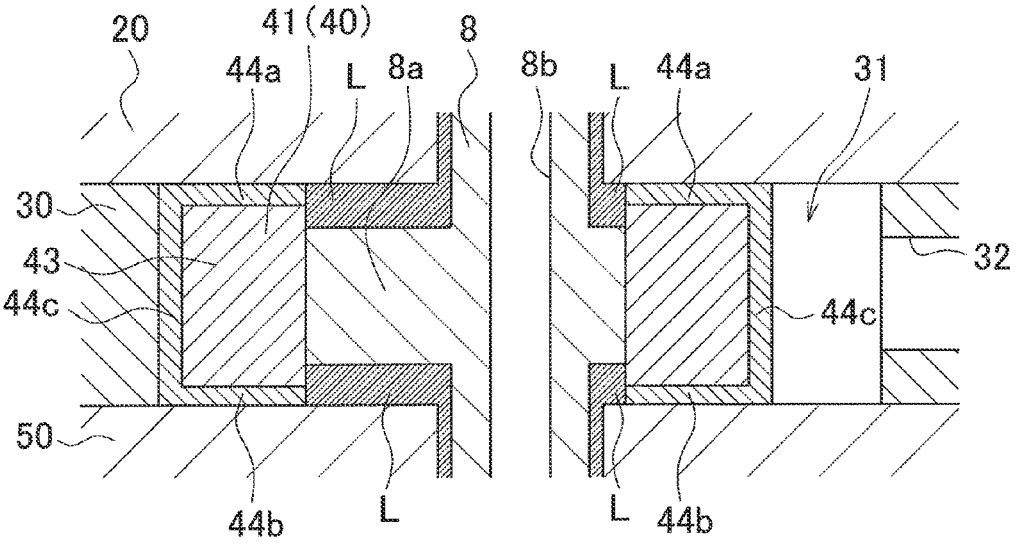
Figure 6:
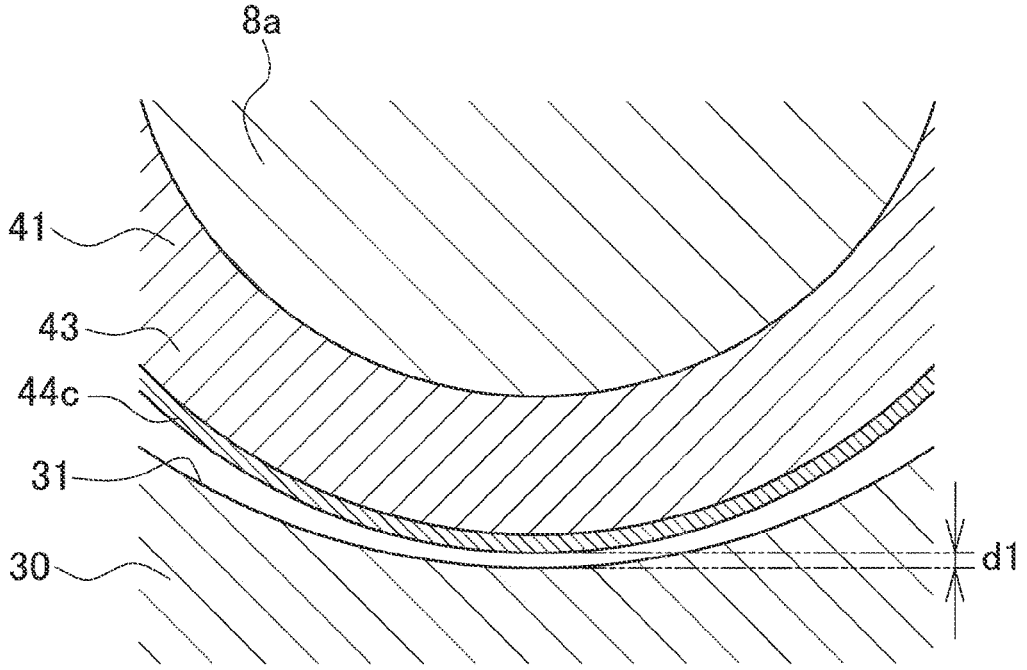
FIG. 6 is a partially enlarged view of FIG. 2.

The FIG. 5 (*a*) and FIG. 6 show the compressor 1 at the time of shipment. As shown in FIG. 5 (*a*), a vertical length H1 of the piston 40 at the time of shipment is slightly smaller than a vertical length H2 of the compression chamber 31, and the difference is, for example, approximately 5 to 15 μm. Further, as shown in FIG. 6, the external diameter of the roller 41 at the time of shipment is such that, while the roller 41 is mounted to the eccentric portion 8*a*, a minute gap d1 of approximately 5 to 30 μm, for example, is formed between the outer circumference surface of the roller 41 and the circumferential wall of the compression, chamber 31 (the gap is hereinafter referred to as radial-directional gap d1).

As shown in FIG. 4, FIG. 5 (*a*), and FIG. 6, the piston 40 of the present embodiment includes: a base 43 of the metal material, a resin layers 44*a* to 44*c* which are each a thin film, coating the surfaces of the base 43. The outer shape of the base 43 constitutes substantially the outer shape of the piston 40. The base 43 is made by sintering of metal powder, casting, cutting or the like, and the surface thereof is polished. The arithmetic mean surface roughness Ra of the surface of the base 43 is, for example, approximately less than 0.3.

The resin layers 44*a*, 44*b* coats the top surface and the under surface of the base 43, respectively. That is, the resin layers 44*a*, 44*b* are formed on the upper and lower end surfaces of the piston, respectively. The resin layer 44*c* is formed on the outer circumference surface of the roller 41. Example resin materials of the material of the resin layers 44*a* to 44*c* include: polyamidimide, polytetrafluoroethylene, or the like, or a mixture of these. The hardness of the resin, layers 44*a* to 44*c* is lower than those of the metal materials constituting the cylinder 30, the front head 20, and the rear head 50. Further, the resin layers 44*a* to 44*c* are hardly swollen at the time of shipment of the compressor 1 (slightly swollen, or not at all swollen). The thickness of each of the resin layers 44*a* to 44*c* at this time is, for example, approximately 10 to 20 μm. Note that the thickness is not limited to the thickness.

Figure 7:
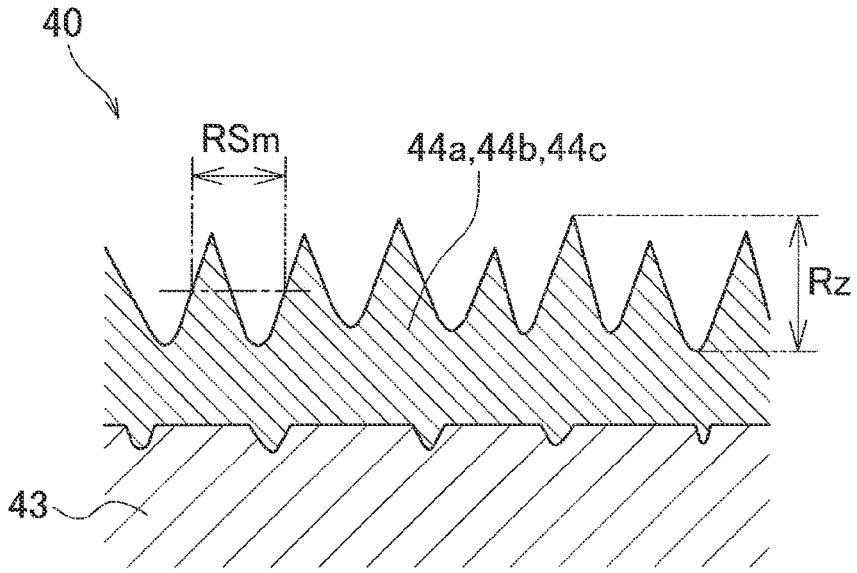
FIG. 7 is an enlarged view schematically showing a cross section of the resin layer and a base.

Further, as shown in FIG. 7, the surfaces of the resin layers 44*a* to 44*c* are relatively rough and their arithmetic mean surface roughness Ra is 0.3 or higher. Note that the arithmetic mean surface roughness Ra, a later-mentioned kurtosis Rku of the roughness curve, the maximum height roughness Rz, and the average length RSm of the roughness curve elements are all in compliance with the JIS B0601:2001. The arithmetic mean surface roughness Ra is an average of absolute values of roughness curves (heights of mountains) within the reference length of the measurement target surface. Note that in FIG. 7, the shapes and sizes of a plurality of protrusions (recesses) constituting the surface roughness of the resin layers 44*a* to 44*c* are substantially the same. However, FIG. 7 is a schematic illustration of the cross section of the resin layers 44*a* to 44*c*, and the shapes and sizes of the protrusions (recesses) may actually be different.

The shape of each protrusion constituting the surface roughness of the resin layers 44*a* to 44*c* preferably has a sharp leading edge as shown in FIG. 7. Specifically, the kurtosis Rku of the roughness curve is 3 or higher.

The shape of each protrusion constituting the surface roughness of the resin layers 44*a* to 44*c* is tapered as shown in FIG. 7, and its height is preferably greater than its width. Specifically, the skewness Rsk of the roughness curve is preferably more than 0, and the maximum height roughness Rz (see FIG. 7) is preferably greater than the average length RSm (see FIG. 7) of the roughness curve elements. Note that each protrusion constituting the surface roughness of the resin layers 44*a* to 44*c* may not have a sharp leading edge. For example, the protrusion may be a round leading edge, or have a trapezoidal cross section. Further, each protrusion constituting the surface roughness of the resin layers 44*a* to 44*c* may have a width that is equal to or less than the height of the same. Specifically, the maximum height roughness Rz may be equal to or less than the average length RSm of the roughness curve elements.

The following describes an exemplary method of forming the resin layers 44*a* to 44*c*. First, a solution of a resin composition is applied and then dried several times on a surface of a base, a polishing process is conducted to make the thickness even, thereby forming a resin coating layer of a predetermined thickness. Note that the polishing process may be omitted. The surface of this resin coating layer is cut by using a specialized tool to form minute protrusions and recesses (i.e., make the surface rough). Note that the minute protrusions and recesses may be formed by applying a laser to the surface of the resin coating layer. Further, the minute protrusions and recesses may be formed by pressing against the surface of the resin coating layer a die having thereon minute protrusions and recesses so as to cause plastic deformation of the resin coating layer into the shape corresponding to the die. The method of forming the resin layers 44*a* to 44*c* is not limited to the one described above.

Next, the following describes an operation of the compressor 1 of the present embodiment, with reference to FIG. 2 (*a*) to FIG. 2 (*d*). FIG. 2 (*a*) shows a state where the piston 40 is at the upper dead center, and FIG. 2 (*b*) to FIG. 2 (*a*) show states where the shaft 8 has rotated by 90°, 180°(lower dead center), and 270° from the state of FIG. 2 (*a*), respectively.

Driving the motor 7 to rotate the shaft 8, while the refrigerant is supplied from, the inlet pipe fitting 3 to the compression chamber 31 through the draw-in hole 32, causes the roller 41 mounted, to the eccentric portion 8*a* to move along the circumferential wall of the compression chamber 31, as shown in FIG. 2 (*a*) to FIG. 2 (*d*). This way, the refrigerant is compressed in the compression chamber 31. The following details how the refrigerant is compressed.

When the eccentric portion 8*a* rotates from the state shown in FIG. 2 (*a*) in the direction of the arrow in the figure, the space formed between the outer circumference surface of the roller 41 and the circumferential wall of the compression chamber 31 is divided into the low pressure chamber 31*a* and the high pressure chamber 31*b*, as shown in FIG. 2 (*b*). When the eccentric portion 8*a* further rotates, the volume of the low pressure chamber 31*a* increases as shown in FIG. 2 (*b*) to FIG. 2 (*d*), and therefore, the refrigerant is drawn from the inlet pipe fitting 3 to the low pressure chamber 31*a* through the draw-in hole 32. At the same time, the volume of the high pressure chamber 31*b* decreases, and this compresses the refrigerant in the high pressure chamber 31*b*.

When the pressure inside the high pressure chamber 31*b* is a predetermined pressure, the valve structure provided to the front head 20 is opened and the refrigerant in the high pressure chamber 31*b* is ejected to the muffler space M through the discharge hole 22. After that, the eccentric portion 8*a* returns to the state shown, in FIG. 2 (*a*), and ejection of the refrigerant from the high pressure chamber 31*b* is completed. Repeating this process enables successive compression and ejection of the refrigerant supplied from the inlet pipe fitting 3 to the compression, chamber 31.

The refrigerant ejected to the muffler space M is ejected outside the compressing structure 10 from the muffler discharge hole (not shown) of the muffler 11. The refrigerant ejected from the compressing structure 10 passes through an air gap between the stator 7*b* and the rotor 7*a*, or the like, and then finally discharged outside the closed casing 2 from the outlet pipe fitting 4.

At this time the lubricating oil L supplied to the compression chamber 31 from the outlet hole 8*c* of the shaft 8 is partially ejected to from the discharge hole 22 to the muffler space M along with the refrigerant, and then ejected from the muffler discharge hole (not shown) of the muffler 11 to the outside the compressing structure 10. The lubricating oil L ejected to the outside the compressing structure 10 is partially returned to the storage at the bottom of the closed casing 2 through the oil-returning hole 23 of the front head 20. Further, another part of the lubricating oil L ejected to the outside the compressing structure 10 passes the air gap between the stator 7*b* and the rotor 7*a* along with the refrigerant, and then returns to the storage at the bottom of the closed casing 2, through the gap between the recess (not shown) formed on the outer circumference surface of the stator 7*b* and the inner circumference surface of the closed, casing 2, and the oil-returning hole 23 of the front head 20.

As described, the vertical length of the piston 40 is slightly smaller than the vertical length of the compression chamber 31. Therefore, during the ordinary operation of the compressor 1, the lubricating oil L ejected from, the outlet hole 8*c* of the shaft 8 exists in the minute gap D1 between the upper end surface of the piston 40 and the front head 20, and in the minute gap D2 between the lower end surface of the piston 40 and the rear head 50 (hereinafter, these gaps are referred to as axial directional gaps D1, D2), as shown, in FIG. 5 (*a*).

Further, as hereinabove described, the external diameter of the roller 41 is such that, while the roller 41 is mounted to the eccentric portion 8*a*, there is a minute radial-directional gap d1 between the circumferential wall of the compression chamber 31 and the outer circumference surface of the roller 41. Therefore, during the ordinary operation of the compressor 1, the lubricating oil L discharged from the outlet hole 8*c* of the shaft 8 is in the radial-directional gap d1, as shown, in FIG. 5 (*a*).

However, during a high-speed activation of the compressor 1, or an operation under a condition such that the temperature of ejected refrigerant and the temperature of drawn-in refrigerant is large, the amount of thermal expansion of the piston 40 becomes greater than that of the cylinder 30. This may cause the axial directional gaps D1, D2 to close up, leading to a problem that the upper and lower end surfaces of the piston 40 contacting the front head 20 and the rear head 50. Further, the and the radial-directional gap d1 may also close up, leading to a problem that the outer circumference surface of the roller 41 contacting the circumferential wall of the compression chamber 31.

Further, when the compressor 1 is continuously used, the resin layers 44*a* to 44*c* may absorb the lubricating oil L or the refrigerant and swell as shown in FIG. 5 (*b*). This may close up the axial directional gaps D1, D2 or the radial-directional gap d1, even the compressor 1 is not operated under a special operating condition.

In cases where the axial directional gaps D1, D2 or the radial-directional gap d1 close (s) up as described above, the slidability of the resin layers 44*a* to 44*c* prevent occurrence of the seizure.

The arithmetic mean surface roughness Ra of each of the surfaces of the resin layers 44*a* to 44*c* is 0.3 or more and is relatively rough. Therefore, when the resin layers 44*a* to 44*c* slide while there surfaces contacting another member, each minute protrusion constituting the surface roughness of the resin layers 44*a* to 44*c* is easily tipped, off or, if not, deformed. This reduces the surface pressure between the contact surfaces, and reduces the frictional loss. Therefore, the efficiency of the compressor 1 is kept from, being deteriorated.

Further, when the kurtosis Rku of the roughness curve on the surface of each of the resin layers 44*a* to 44*c* is 3 or more, each protrusion constituting the surface roughness of the resin layers 44*a* to 44*c* has a sharp leading edge. This easily wears out or deforms the protrusions of another member, when the resin layers 44*a* to 44*c* are in contact with the other member. Thus, the surface pressure between the contact surfaces is promptly and reliably reduced.

Further, when the skewness Rsk of the roughness curve on the surface of each of the resin layers 44*a* to 44*c* is more than 0, and the maximum height roughness Rz is greater than the average length RSm of the roughness curve element, each protrusion constituting the surface roughness of the resin layers 44*a* to 44*c* has a tapered shape, and its height is greater than its width. This easily wears out or deforms the protrusions of another member, when the resin layers 44*a* to 44*c* are in contact with the other member. Thus, the surface pressure between the contact surfaces is promptly and reliably reduced.

Further, the hardness of the resin layers 44*a* to 44*c* are less than the surface opposing to these layers. Therefore, the protrusions constituting the surface roughness of the resin layers 44*a* to 44*c* are easily worn out.

<Second Embodiment>

Next, the following describes a second embodiment of the present invention.

The present embodiment is an exemplary application of the present invention to a dual-cylinder rotary compressor.

Figure 8:
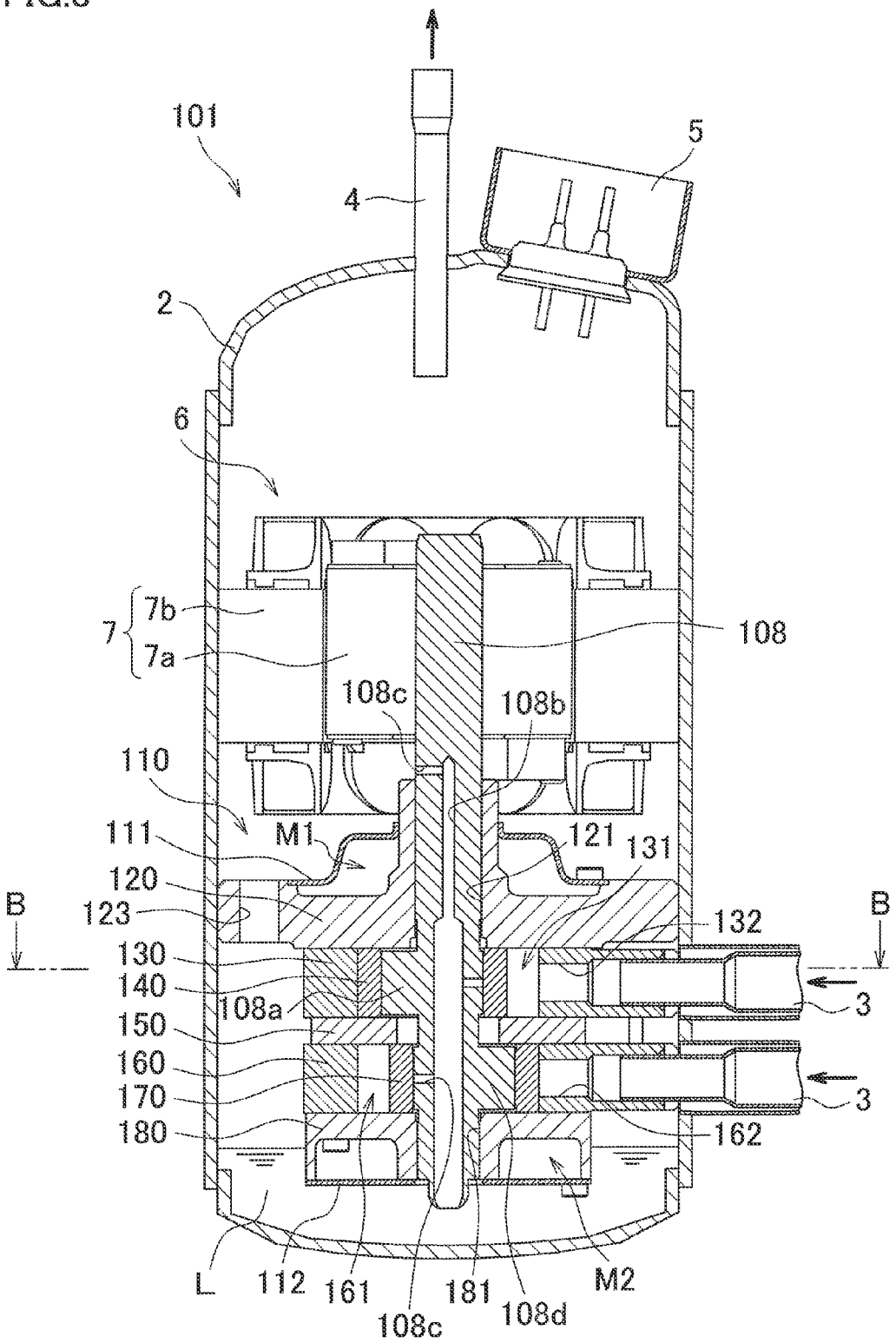
FIG. 8 is a schematic cross sectional view of a compressor related to a second embodiment of the present invention.

As shown in FIG. 8, a compressor 101 of the present embodiment is different from First Embodiment in the structures of the shaft 108 and the compressing structure 110. Further, the compressor 101 of the present embodiment has two inlet pipe fittings 3 on a side of the closed casing 2, aligned in the vertical direction. The structure other than the above is the same as that of First Embodiment. Therefore, the same reference numerals are given and the explanations are omitted as needed.

The shaft 108 has two eccentric portions 108*a*, 108*d*. The shaft centers of the two eccentric portions 108*a*, 108*d* are shifted, from each other by 180° about the rotational axis of the shaft 108. Further, as in the shaft 8 of First Embodiment, the shaft 108 has a lubrication path 108*b* and a plurality of outlet holes 108*c*.

The compressing structure 110 sequentially has, from the top to the bottom along the axial direction of the shaft 108, a front muffler 111, a front head 120, a cylinder 130, a piston 140, a middle plate 150, a cylinder 160, piston 170, a rear head 180, and a rear muffler 112. The front head 120 and the middle plate 150 are disposed at the upper and lower ends of the piston 140, and correspond to the first end plate member and the second end plate member of the present invention, respectively. Further, the middle plate 150 and the rear head 180 are disposed at the upper and lower ends of the piston 170, and correspond to the first end plate member and the second end plate member of the present invention, respectively.

The front muffler 111 has a structure similar to that of the muffler 11 of First Embodiment, and forms a muffler space M1 between the muffler 111 and the front head 120.

To the front head 120 are formed a bearing hole 121, a discharge hole 122 (see FIG. 9), and an oil-returning hole 123. Further, the front head 120 has a through hole (not shown) penetrating the front head 120 in the vertical direction. The through hole constitute a part of the passage for discharging a refrigerant in the muffler space M2 formed by the rear head 180 and the rear muffler 112 to the muffler space M1. The structure of the front head 120 other than this through hole is the same as that of the front head 20 of First Embodiment.

Figure 9:
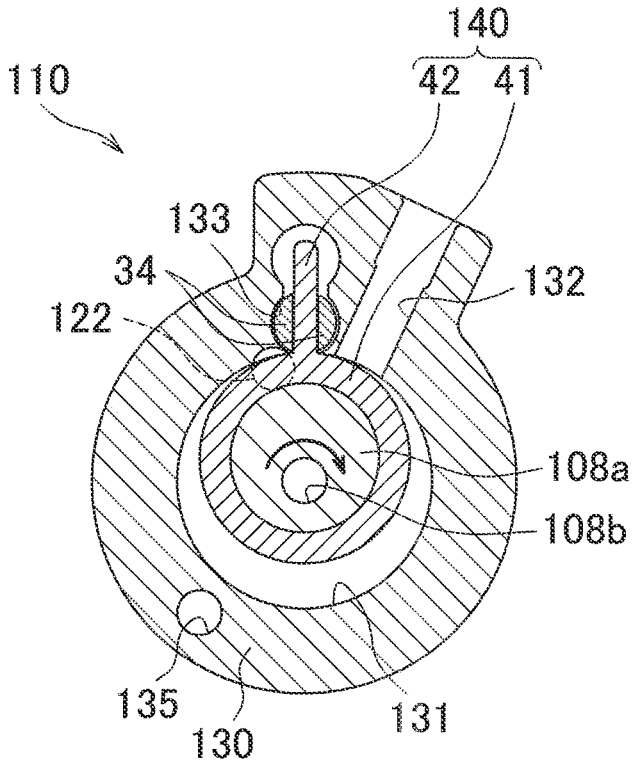
FIG. 9 is a cross sectional view taken along the line B-B of FIG. 8.
Figure 10A:
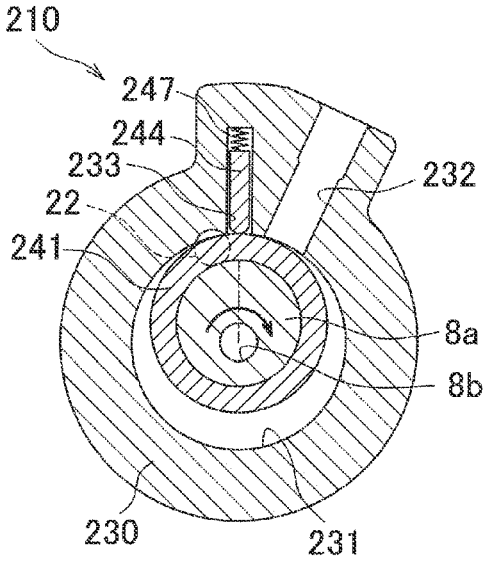
FIG. 10 is a diagram showing an operation of a roller and a vane in the cylinder of the compressor related to a Third Embodiment of the present invention.
Figure 10B:
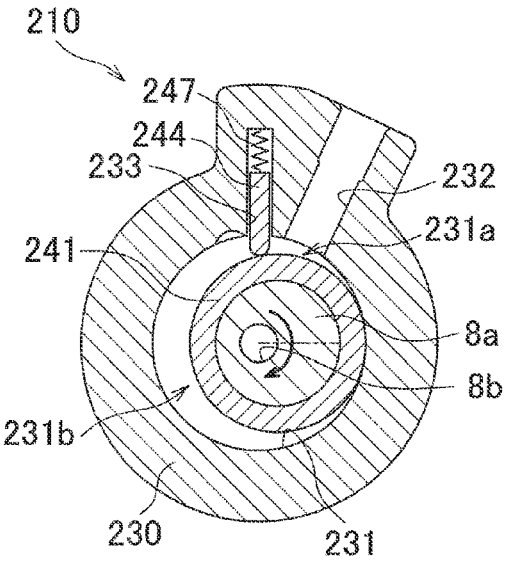
Figure 10C:
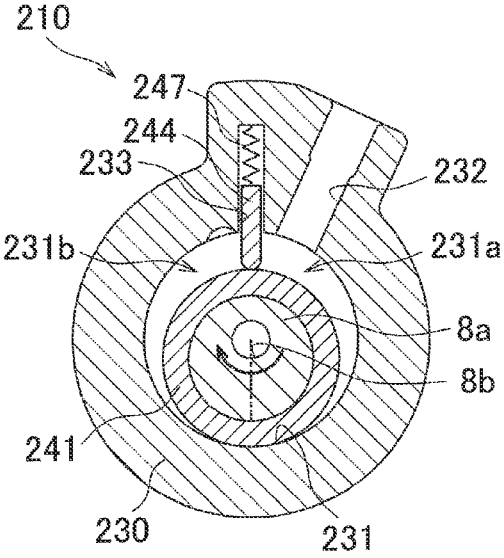
Figure 10D:
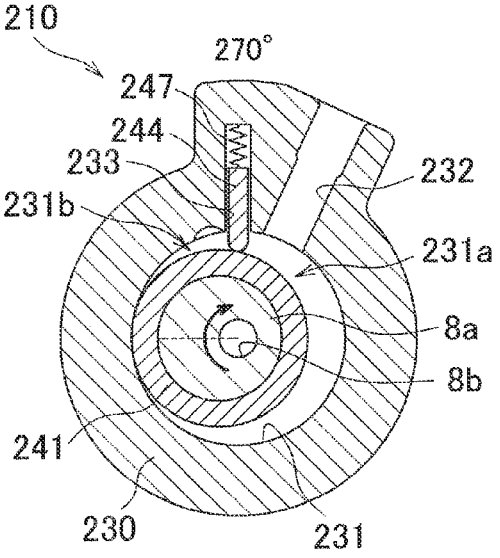

As shown in FIG. 9, in the cylinder 130 are formed a compression chamber 131, a draw-in hole 132, and a blade housing 133. Further, the cylinder 130 has a through hole 135 formed at its outer circumference-side portion of the compression chamber 131. The through hole 135 is for discharging the refrigerant in the later-mentioned muffler space M2 to the muffler space M1. The structure of the cylinder 130 other than this through hole 135 is the same as that of the cylinder 30 of First Embodiment.

The structure of the piston 140 is similar to that of the piston 40 of First Embodiment, and includes a roller 41 and a blade 42. The roller 41 is rotatably mounted to the outer circumference surface of the eccentric portion 108*a*. The blade 42 is disposed between a pair of bushes 34 in the blade housing 133 of the cylinder 130 and is capable of moving forward and backward. The piston 140 includes a base 43 made of a metal material, and resin layers 44*a* to 44*c* which are each, a thin film coating the surfaces of the base 43, as in the case with the piston 40 of First Embodiment.

The middle plate 150 is an annular plate member which is disposed between the cylinder 130 and the cylinder 160, and closes the lower end of the compression chamber 131 of the cylinder 130 while closing the upper end of the compression chamber 131 of the cylinder 160. Further, the middle plate 150 has a through hole (not shown) for discharging the refrigerant in the later-mentioned muffler space M2 to the muffler space M1. The middle plate 150 is made of a metal material and is formed, by means of sintering of metal powder, casting, cutting, or the like. The surface of the middle plate 150 is polished.

The structure of the cylinder 160 is similar to that of the cylinder 130, and includes a compression chamber 161, a draw-in hole 162, a blade housing (not shown) in which the pair of bushes 34 are disposed, and a through hole (not shown).

The structure of the piston 170 is similar to that of the piston 40 of First Embodiment and includes the roller 41 and the blade 42. The roller 41 is rotatably mounted to the outer circumference surface of the eccentric portion 108*d*. The blade 42 is disposed between a pair of bushes 34 in the blade housing (not shown) of the cylinder 160 and is capable of moving forward and backward. The piston 170 includes a base 43 made of a metal material, and resin layers 44*a* to 44*c* which are each a thin film coating the surfaces of the base 43, as in the case with the piston 40 of First Embodiment.

The rear head 180 is disposed on the lower side of the cylinder 160 and closes the lower end of the compression chamber 131 of the cylinder 160. The rear head 180 is a substantially annular member, and its center portion has a bearing hole 181 into which the shaft 108 is rotatably inserted. Further, to the rear head 180 is formed a discharge hole (not shown) for discharging the refrigerant compressed in the compression chamber 161 of the cylinder 160 to the muffler space M2 formed between the rear head 180 and the rear muffler 112. Further, to the rear head 180 is formed a through hole (not shown) for discharging the refrigerant in the muffler space M2 to the muffler space M1. On the under surface of the rear head 180 is provided a valve structure (not shown) which opens and closes the discharge hole according to the pressure in the compression chamber 131. The rear head 180 is made of a metal material and is formed by means of sintering of metal powder, casting, cutting, or the like. The surface of the rear head 180 is polished.

The rear muffler 112 is provided for reducing the noise generated when the refrigerant is ejected from the discharge hole (not shown) from the rear head 180. The rear muffler 112 is attached to the under surface of the rear head 180 by using a bolt and forms the muffler space M2 between the rear muffler 112 and the rear head 180. The muffler space M2 is in communication with the muffler space M1 through the through holes of the rear head 180, the cylinder 160, the middle plate 150, the cylinder 130, and the front head 120.

The following describes an operation of the compressor 101 of the present embodiment.

When, the motor 7 is driven to rotate the shaft 108, while supplying the refrigerant from the draw-in holes 132, 162 to the compression chambers 131, 161, the roller 41 of the piston 140 mounted to the eccentric portion 108*a* moves along the circumferential wall of the compression chamber 131. This compresses the refrigerant in the compression chamber 131. Meanwhile, the roller 41 on the piston 170 mounted to the eccentric portion 108*d* moves along the circumferential wall of the compression chamber 161. This compresses the refrigerant in the compression chamber 161.

When the pressure inside the compression chamber 131 reaches a predetermined pressure or higher, the valve structure provided to the front head 120 opens and the refrigerant in the compression chamber 131 is ejected to the muffler space M1 from the discharge hole 22 on the front head 120. Further, when the pressure inside the compression chamber 161 reaches a predetermined pressure or higher, the valve structure provided to the rear head 180 opens and the refrigerant in the compression chamber 161 is ejected to the muffler space M2 from the discharge hole (not shown) on the rear head 180. The refrigerant ejected to the muffler space M2 is then ejected to the muffler space M1 through the through holes of the rear head 180, the cylinder 160, the middle plate 150, the cylinder 130, and the front head 120.

The refrigerant ejected to the muffler space M1 is ejected outside the compressing structure 110 from the muffler discharge hole (not shown) of the front muffler 111, passes the air gap between the stator 7*b* and the rotor 7*a*, and then discharged from the outlet pipe fitting 4 to outside the closed casing 2.

As in First Embodiment, since the resin layers 44*a* to 44*c* with rough surfaces are provided to the upper and lower end surfaces of the pistons 140 and the 170, and the outer circumference surface of the roller 41, the compressor 101 of the present embodiment brings about effects similar to those brought about in First Embodiment, when members opposing to the resin layers 44*a* to 44*c* contact the resin layers 44*a* to 44*c*.

<Third Embodiment>

Next, the following describes a Third Embodiment of the present invention.

A compressor of the present embodiment is a mono cylinder rotary compressor, and is different from First Embodiment in the structure of its compressing structure 210. The structure other than the above is the same as that of First Embodiment. Therefore, the same reference numerals are given and the explanations are omitted as needed.

As shown in FIG. 10, the compressing structure 210 is different from the cylinder 230 in its structure of the members arranged inside the cylinder 230; however, the structures other than that are the same as those of First Embodiment.

The cylinder 230 has a compression chamber 231 and a draw-in hole 232. Further, the cylinder 230 has a vane storage unit 233 in place of the blade housing 33 of First Embodiment, and the structures other than that are the same as those of the cylinder 30 of First Embodiment. The vane storage unit 233 penetrates the cylinder 230 in the vertical direction, and is in communication with the compression chamber 231. Further, the vane storage unit 233 extends in a radial direction of the compression chamber 231.

Inside the compression chamber 231 is an annular roller 241. The roller 241 is disposed inside the compression chamber 231 and is mounted to the outer circumference surface of the eccentric portion 8*a* of the shaft 8 so that relative rotation is possible. The vertical length of the roller 241 is the same as the vertical length H1 of the piston 40 of First Embodiment. Further, the external diameter of the roller 241 is the same as that of the roller 41 of the piston 40 of First Embodiment.

Figure 11:
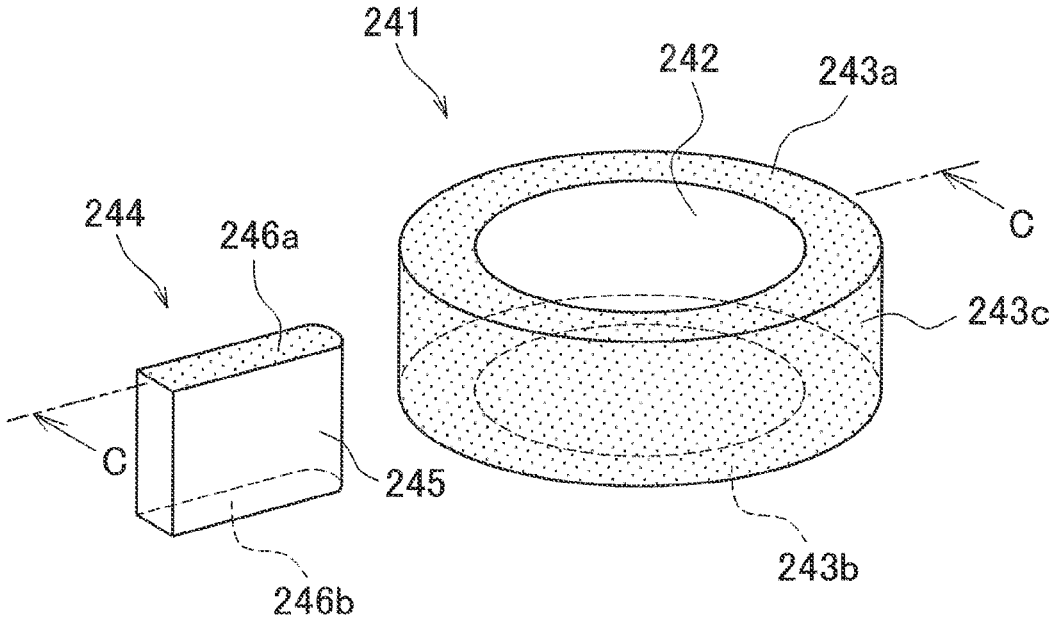
FIG. 11 is a perspective diagram of the roller and the vane in the compressor shown in FIG. 10.

Inside the vane storage unit 233 is disposed a vane 244. As shown in FIG. 11, the vane 244 is a flat plate member and its vertical length is the same as the vertical length of the roller 241. The leading end portion of the vane 244, which is an end on the side closer to the center of the compression chamber 231 (the leading end portion on the lower side in FIG. 10), has a tapered shape when viewed from the top. Further, the vane 244 is biased by a biasing spring 247 provided inside the vane storage unit 233, and the leading end portion on the side of the compression chamber 231 is pressed against the outer circumference surface of the roller 241. Therefore, as shown in FIG. 10(*a*) to FIG. 10(*d*), when the roller 241 moves along the circumferential wall of the compression chamber 231 with rotation of the shaft 8, the vane 244 moves forward and backward in a radial direction of the compression chamber 231 within the vane storage unit 233. Further, as shown in FIG. 10(*b*) to FIG. 10 (*d*), when the vane 244 sticks out from the vane storage unit 233 towards the compression chamber 231, the space formed between the outer circumference surface of the roller 241 and the circumferential wall of the compression chamber 231 is divided into a low pressure chamber 231*a* and the high pressure chamber 231*b* by the vane 244.

Figure 12:
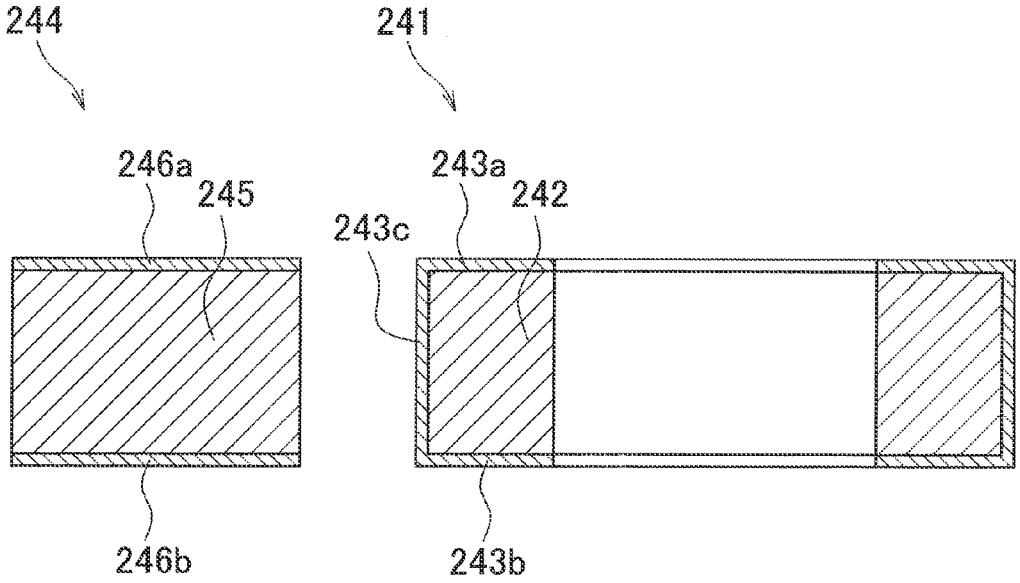
FIG. 12 is a cross sectional view taken along the line C-C of FIG. 11.

As shown in FIG. 11 and FIG. 12, the roller 241 includes a base 242 made of a metal material, and resin layers 243*a* to 243*c* which are thin, films coating the surfaces of the base 242. Further, the vane 244 includes a base 245 made of a metal material, and resin layers 246*a*, 246*b* which are thin films coating the surfaces of the base 245.

As shown in FIG. 12, the bases 242, 245 have a shape similar to the shapes of the roller 241 and the vane 244. The bases 242, 245 are made by sintering metal powder, casting, or cutting, and their surfaces are polished.

The resin layers 243*a*, 243*b* of the roller 241 coats the top surface and the under surface of the base 242, respectively. In other words, the resin layers 243*a*, 243*b* are formed on the upper and lower end surfaces of the roller 241, respectively. Further, the resin layer 243*c* is formed on the outer circumference surface of the roller 241.

Further, the resin layers 246*a*, 246*b* of the vane 244 are formed on the top surface and the under surface of the base 245, respectively. In other words, the resin layers 246*a*, 246*b* are formed on the upper and lower end surfaces of the vane 244. The material and the film thickness of the resin layers 243*a* to 243*c*, 246, 246*b* are the same as those of the resin layers 44*a* to 44*c* on the piston 40 of First Embodiment.

Further, the surfaces of the resin layers 243*a* to 243*c*, 246*a*, 246*b* are made rough as is the case of the surfaces of the resin layers 44*a* to 44*c* on the piston 40 of First Embodiment.

Next, the following describes an operation of the compressor of the present embodiment.

The FIG. 10(*a*) shows that the roller 241 is at the upper dead center, and FIG. 10(*b*) to FIG. 10(*d*) shows states where the shaft 8 rotates by 90°, 180°(lower dead center), and 270° from the state of FIG. 10(*a*), respectively.

when the motor 7 is driven to rotate the shaft 8, while the refrigerant is supplied from the inlet pipe fitting 3 to the compression chamber 231 through the draw-in hole 232, the roller 241 mounted to the eccentric portion 8*a* moves along the circumferential wall of the compression chamber 231, as shown in FIG. 10(*a*) to FIG. 10(*d*). This compresses the refrigerant in the compression chamber 231. The following details the process in which the refrigerant is compressed.

When the eccentric portion 8*a* rotates in the direction shown by the arrow in the figure from the state shown in FIG. 10(*a*), the space formed between the outer circumference surface of the roller 241 and the circumferential wall of the compression chamber 231 is divided into a low pressure chamber 231*a* and a high pressure chamber 231*b*, as shown in FIG. 10(*b*). When the eccentric portion 8*a* further rotates, the volume of the low pressure chamber 231*a* increases as shown in FIG. 10(*b*) to FIG. 10(*d*). Therefore, the refrigerant is drawn into the low pressure chamber 231*a* from the inlet pipe fitting 3 through the draw-in hole 232. At the same time, the volume of the high, pressure chamber 231*b* is reduced. Therefore, the refrigerant in the high pressure chamber 231*b* is compressed.

Then, when the pressure inside the high, pressure chamber 231*b* reaches a predetermined pressure or higher, the valve structure provided to the front head 20 is opened, and the refrigerant in the high pressure chamber 231*b* is ejected to the muffler space M from the discharge hole 22. The refrigerant ejected to the muffler space M flows the path similar to the compressor 1 of First Embodiment, and at the end, is discharged from the outlet pipe fitting 4 to the outside the closed casing 2.

In the compressor 201 of the present embodiment, the resin layers 243*a* to 243*c*, 246*a*, 246*b*, whose surfaces are made rough as it the case of the resin layers 44*a* to 44*c* of First Embodiment, are formed on the upper and lower end surfaces of the roller 241, the outer circumference surface of the roller 241, and the upper and lower end surfaces of the vane 244. This brings about the effects similar to those brought about by First Embodiment, when the opposing members contact the resin layers 243*a* to 243*c*, 246*a*, and 246*b*.

<Fourth Embodiment>

Next, the following describes a fourth embodiment of the present invention.

The present embodiment is an exemplary application of the present invention to a scroll compressor.

Figure 13:
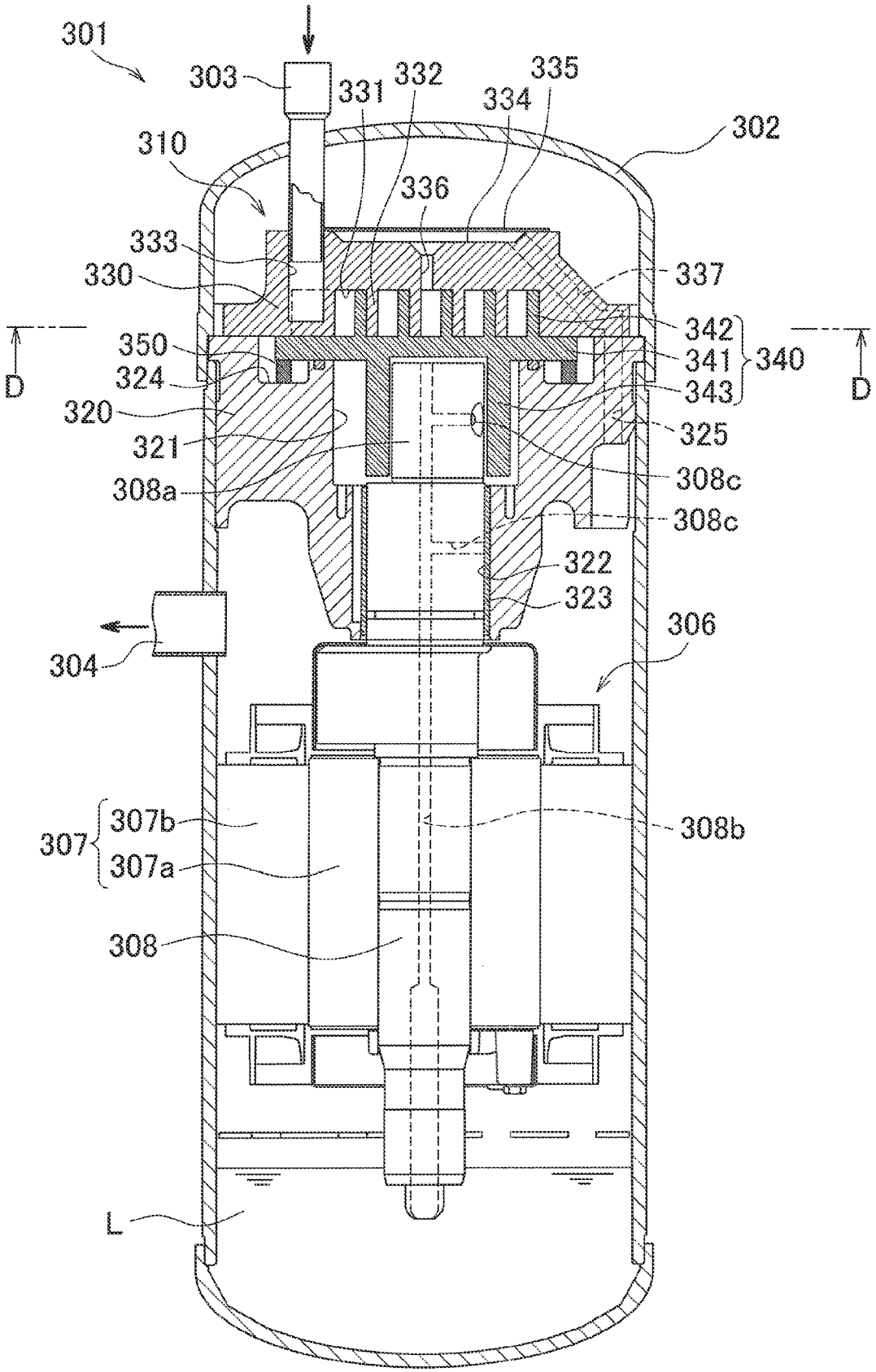
FIG. 13 is a schematic cross sectional view of a compressor related to a fourth embodiment of the present invention.
Figure 14A:
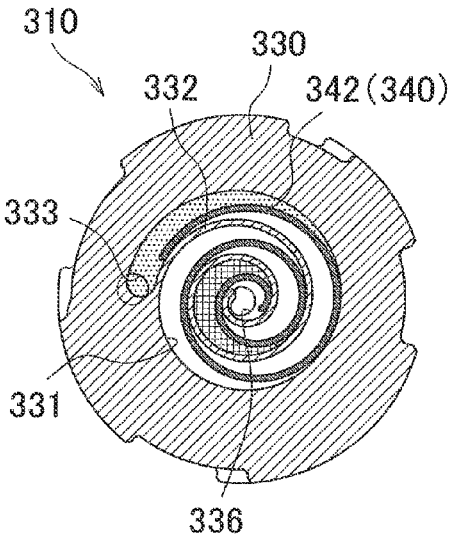
FIG. 14 is a cross sectional view taken along the line D-D of FIG. 13, and is a diagram showing an operation of the moveable scroll.
Figure 14B:
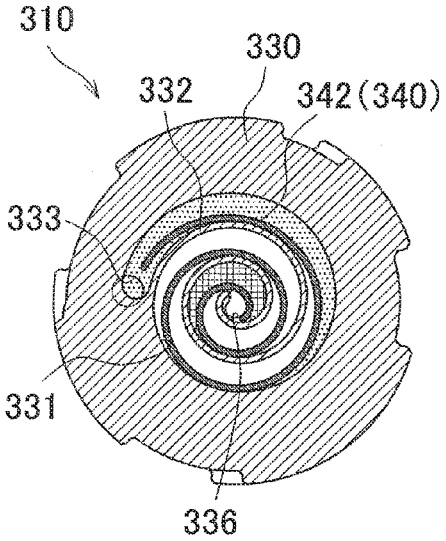
Figure 14C:
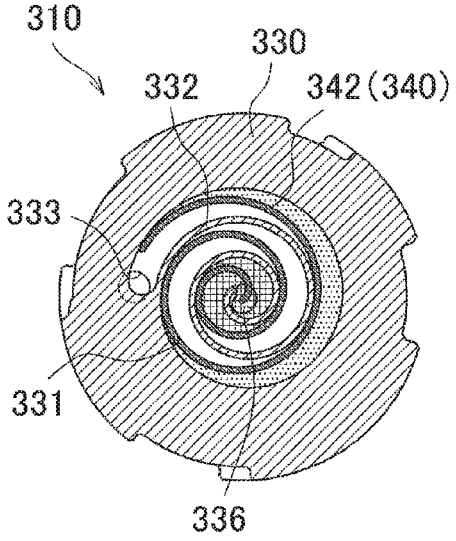
Figure 14D:
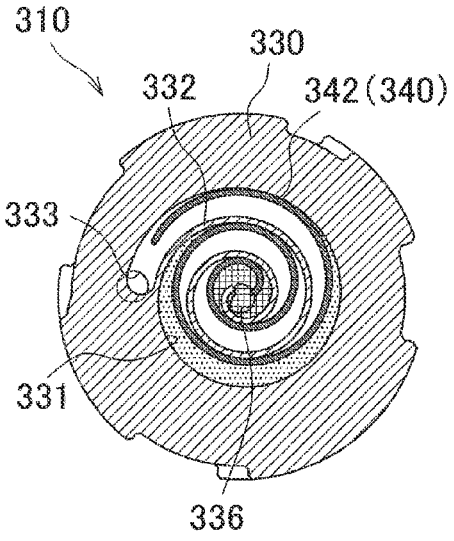

As shown in FIG. 13, a compressor 301 of the present embodiment includes a closed, casing 302, a compressing structure 310 disposed inside the closed casing 302, and the drive mechanism 306. FIG. 13 omits hatching that indicates the cross section of the drive mechanism 306. The following description of the compressor 301 assumes that the up/down direction of the FIG. 13 is the vertical direction.

The closed casing 302 is a cylindrical container with its both ends closed. On top of the closed casing 302 is provided an inlet pipe fitting 303 for introducing the refrigerant. On a side of the closed casing 302 is provided an outlet pipe fitting 304 for discharging the compressed refrigerant, and a terminal (not shown) for supplying electricity to the coil of a later-mentioned stator 307*b* in the drive mechanism 306. Further, at the bottom in the closed casing 302 is stored a lubricating oil L for smoothening the operation of the slide portion in the compressing structure 310. Inside the closed casing 302, the compressing structure 310 and the drive mechanism 306 are disposed, aligned in the vertical direction.

The drive mechanism 306 includes a motor 307 serving as a drive source, and a shaft 308 attached to this motor 307. In other words, it includes the motor 307 and the shaft 308 for transmitting the drive force of the motor 307 to the compressing structure 310.

The structure of the motor 307 is substantially the same as that of the motor 7 of First Embodiment, and includes a substantially annular stator 307*b* which is fixed to the inner circumference surface of the closed casing 302, and a rotor 307*a* disposed on the radially inner side of the stator 307*b* with an air gap therebetween. Further, the outer circumference surface of the stator 307*b* is not entirely in close contact with the inner circumference surface of the closed casing 302, i.e., a plurality of recesses (not shown) extending in the vertical direction and communicating the spaces above and below the motor 307 are provided along the outer circumference surface of the stator 307*b*.

The shaft 308 is for transmitting the drive force of the motor 307 to the compressing structure 310, and is fixed to the inner circumference surface of the stator 307*b* to rotate integrally with the rotor 307*a*. The shaft 308 has at its upper end portion an eccentric portion 308*a*. This eccentric portion 308*a* has a cylindrical shape and its shaft center is deviated from the rotational center of the shaft 308. To this eccentric portion 308*a* is mounted a later-mentioned bearing portion 343 of the moveable scroll 340.

Further, in the shaft 308 is formed a lubrication path 308*b* which penetrates the shaft 308 in the vertical direction. At the lower end portion of this lubrication path 308*b* is a pump member (not shown) for drawing in the lubricating oil L into the lubrication path 308*b* with rotation of the shaft 308. Further, the shaft 308 has a plurality of outlet holes 308*c* for discharging the lubricating oil L in the lubrication path 308*b* to the outside the shaft 308.

The compressing structure 310 includes a housing 320 fixed to the inner circumference surface of the closed casing 302, a fixed scroll (first scroll) 330 disposed on top of the housing 320, a moveable scroll (second scroll) 340 disposed between the housing 320 and the fixed scroll 330.

The housing 320 is a substantially annular member, and is press fit and fixed to the closed casing 302. The entire outer circumference surface of the housing 320 is closely attached to the inner circumference surface of the closed casing 302. At the center portion of the housing 320 are formed, an eccentric portion storage hole 321 and a bearing hole 322 whose diameter is smaller than the eccentric portion storage hole 321. The eccentric portion storage hole 321 and the bearing hole 322 are aligned in the vertical direction. Inside the eccentric portion storage hole 321, the eccentric portion 308*a* of the shaft 308 is stored while being inserted inside the bearing portion 343 of the moveable scroll 340. The bearing hole 322 supports the shaft 308 so as to enable relative rotation of the shaft 308 through the bearing 323. Further, an annular groove 324 is formed on the top surface of the housing 320, on the outer circumference-side of the eccentric portion storage hole 321. Further, on the outer circumference-side of the annular groove 324 is a communication hole 325 penetrating the housing 320 in the vertical direction.

As shown in FIG. 13 and FIG. 14, the fixed scroll 330 is a substantially disc-like member, whose outer circumference-side portion of the under surface is fixed to the housing-320 by using a bolt (not shown) so as to closely contact the top surface of the housing 320. At the center portion on the under surface of the fixed scroll 330 is formed a substantially circular recess 331. Further, on the bottom surface (ceiling surface) of the recess 331 is formed a fixed-side wrap (first wrap) 332 having a spiral shape, which project downwards. The under surface (excluding the bottom surface of the recess 331) of the fixed scroll 330 and the leading end surface of the fixed-side wrap 332 are substantially flush with each other. Further, as shown in FIG. 14, the end portion (winding-end end portion) of the fixed-side wrap 332, on the outer circumference-side is connected to the circumferential wall of the recess 331.

Further, as shown in FIG. 13, the fixed scroll 330 has a draw-in path 333 extended from the top surface to the vicinity of the under surface of the fixed scroll 330. The draw-in path 333 is for introducing a refrigerant into the recess 331. At the upper end of the draw-in path 333 is inserted an inlet pipe fitting 303. As shown in FIG. 14, the lower end of this draw-in path 333 is formed on the bottom surface of the recess 331, where the radius of the recess 331 is the largest.

At substantially the center portion of the top surface of the fixed scroll 330, an indentation 334 is formed, and a cover member 335 is attached to the fixed scroll 330 so as to cover the indentation 334. Further, at the bottom surface of the indentation 334 is formed a discharge hole 336 extended downward and in communication with the recess 331. The lower end of the discharge hole 336 is formed at substantially the center portion of the bottom surface of the recess 331. Further, on the fixed scroll 330 is formed a communication hole 337 which communicates a space surrounded by the indentation 334 and the cover member 335 with the communication hole 325 formed on the housing 320. Note that FIG. 14 omits illustration of the bolt hole formed on the fixed scroll 330, and a later-mentioned communication hole 337. Further, the fixed scroll 330 is made of a metal material, and is formed by sintering metal powder, casting, cutting, or the like.

The moveable scroll 340 includes a disc-like flat plate section 341, a spiral moveable-side wrap 342 projecting upward from the top surface of the flat plate section 341, and a cylindrical bearing portion 343 which projects downwards from the under surface of the flat plate section 341. Inside the bearing portion 343 is inserted the eccentric portion 308*a* so that relative rotation is possible.

The flat plate section 341 is sandwiched by the under surface of the fixed scroll 330 and the upper end of the peripheral wall section of the eccentric portion storage hole 321. Further, the flat plate section 341 is supported by the housing 320 through the Oldham ring 350 disposed in the annular groove 324. The Oldham ring 350 is for preventing the rotation movement of the moveable scroll 340, and has sub-protrusions (not shown) on its top and under surfaces. The sub-protrusions engage with linear grooves (not shown) formed on the housing 320 and the moveable scroll 340 and which extend in a direction perpendicular to each other. This way the Oldham ring 350 is able to move relatively to the housing 320 and the moveable scroll 340 (i.e., two directions perpendicular to each other). Therefore, the moveable scroll 340 is moveable in horizontal directions with respect to the housing 320, while keeping its orientation (angle) constant. With the fiat plate section 341 supported, by the housing 320 through the Oldham ring 350 and with the eccentric portion 308*a* inserted into the bearing portion 343 so that relative rotation is possible, rotation of eccentric portion 308*a* (shaft 308) causes the moveable scroll 340 to move (circle) about the rotational axis of the shaft 308, without rotating about the center of the moveable scroll 340.

Further, the flat plate section 341 has a small hole (not shown) which guides the compressed refrigerant in the recess 331 to the eccentric portion storage hole 321 of the housing 320. Thus, during the operation of the compressor 301, the flat plate section 341 receives an upward force from the high-pressure refrigerant in the eccentric portion storage hole 321, and the top surface of the flat plate section 341 is pressed against the under surface of the fixed scroll 330. This prevents the high-pressure refrigerant in the recess 331 from pressing the moveable scroll 340 downward, increasing later-mentioned axial directional gaps D3, D4.

Further, as shown in FIG. 14, the moveable-side wrap 342 of the moveable scroll 340 is substantially symmetrical to the fixed-side wrap 332 of the fixed scroll 330, and is disposed on the flat plate section 341 so as to engage with the fixed-side wrap 332. Thus, a plurality of substantially crescent spaces are formed between the side surface of the fixed-side wrap 332 and the circumferential wall of the recess 331 and the side surface of the moveable-side wrap 342.

Figure 15A:
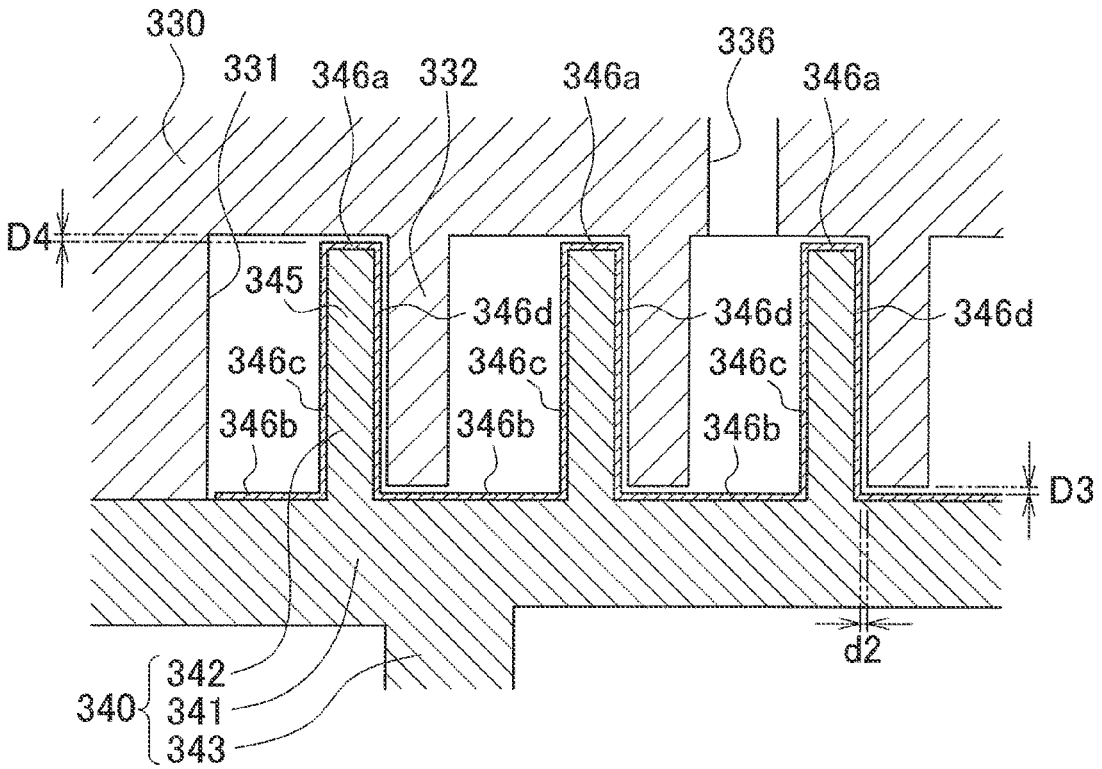
FIG. 15(*a*) is a partially enlarged view of FIG. 13, and FIG. 15 (*b*) is a partially enlarged view of FIG. 14.
Figure 15D:
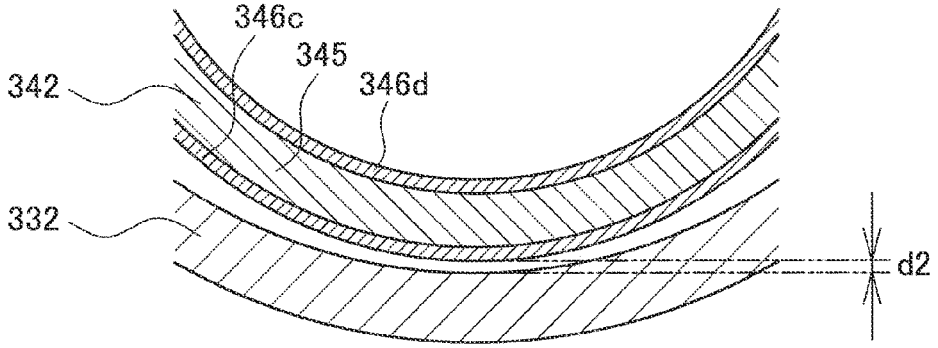

FIG. 15(*a*) and FIG. 15(*b*) show the compressor 301 at the time of shipment. As shown in FIG. 15(*b*), the moveable-side wrap 342 is formed so as to move along the side surface of the fixed-side wrap 332 when the moveable scroll 340 circles, while the side surface of the moveable-side wrap 342 approximates to the side surface of the fixed-side wrap 332 and the circumferential wall of the recess 331 with a minute gap d2 (hereinafter, the gap is referred to as radial-directional gap d2) of, for example, 10 to 30 μm therebetween. Further, as shown in FIG. 15 (*a*), between the top surface of the flat plate section 341 of the moveable scroll 340 and the leading end surface of the fixed-side wrap 332, and between the bottom surface of the recess 331 of the fixed scroll 330 and the leading end surface of the moveable-side wrap 342, there are minute gaps D3, D4 (hereinafter, these gaps are referred to as axial directional gaps D3, D4) of, for example, approximately 10 to 30 μm, respectively.

As shown in FIG. 15, the moveable scroll 340 of the present embodiment includes: a base 345 made of a metal material and resin layers 346*a* to 346*d* which are thin films covering the surfaces of the base 345. The shape of the base 345 is substantially the shape of the moveable scroll 340. The base 345 is formed by sintering of metal powder, casting, cutting, or the like.

As shown in FIG. 15(*a*), the resin layer 346*a* is formed on a leading end surface of the moveable-side wrap 342. Further, the resin layer 346*b* is formed in an area of the top surface of the flat plate section 341, which opposes the bottom, surface of the recess 331 (an area of the fixed-side wrap 332 opposing the leading end surface). Further, as shown in FIG. 15(*a*) and FIG. 15 (*b*), the resin layers 346*c*, 346*d* are formed on the outer circumference surface and the inner circumference surface of the moveable-side wrap 342. The material of the resin layers 346*a* to 346*d* and the film thickness of the same at the time of shipment are the same as the resin layers 44*a* to 44*c* on the piston 40 of First Embodiment. Note that, as in First Embodiment, the resin layers 346*a* to 346*d* at the time of shipment are hardly swollen. Further, the surfaces of the resin layers 346*a* to 346*d* are made rough as in the case of the surfaces of the resin layers 44*a* to 44*c* on the piston 40 of First Embodiment.

Next, the following describes an operation of the compressor 301 of the present embodiment, with reference to FIG. 14(*a*) to FIG. 14(*d*), FIG. 14(*b*) to FIG. 14(*d*) show the states where the shaft 308 has rotated by 90°, 180°, and 270° from the state shown in FIG. 14(*a*).

When the motor 307 is driven to rotate the shaft 308, while the refrigerant is supplied from the inlet pipe fitting 303 to the recess 331 through the draw-in path 333, the moveable scroll 340 mounted to the eccentric portion 308*a* circles without rotating, as shown in FIG. 14(*a*) to FIG. 14(*d*). With this, the substantially crescent spaces formed by the side surfaces of the moveable-side wrap 342, the fixed-side wrap 332, and the circumferential wall of the recess 331 move towards the center, while reducing their volumes. This way the refrigerant is compressed, in the recess 331.

In the following description, with reference to FIG. 14(*a*), on the process of compressing the refrigerant, the substantially crescent spaces (spaces indicated by dot hatching in the figure) at the outermost circumference is focused.

In the state shown in FIG. 14(*a*), the refrigerant is supplied from the draw-in path 333 into the substantially crescent space. When the shaft 308 rotates from this state, the volume of the space increases as shown in FIG. 14(*b*), and the refrigerant is drawn in from the draw-in path 333. When the shaft 308 further rotates from this state, the crescent space moves towards the center as shown in FIG. 14(*c*) and FIG. 14(*d*), and the space is no longer in communication with the draw-in path 333 and its volume decreases. Therefore, in this space, the refrigerant is compressed. With the rotation of the shaft 308, the space further moves towards the center and shrinks. When the shaft 308 rotates twice, the space moves to the position indicated by grid hatching in FIG. 14(*a*). When the shaft 308 further rotates, the space matches with a space surrounded by the inner circumference surface of the moveable-side wrap 342 and the outer circumference surface of the fixed-side wrap 332, and is in communication with the discharge hole 336 as indicated by the grid hatching in FIG. 14(*c*). This way, the compressed refrigerant in the space is ejected from the discharge hole 336.

The refrigerant ejected from the discharge hole 336 passes the communication hole 337 of the fixed scroll 330 and the communication hole 325 of the housing 320 and then discharged into the space below the housing 320. Then, the refrigerant is finally ejected to the outside the closed casing 302 from the outlet pipe fitting 304.

As hereinabove mentioned, the axial directional gaps D3, D4 are formed between the leading end surface of the fixed-side wrap 332 and the top surface of the flat plate section 341 of the moveable scroll 340 and between the leading end surface of the moveable-side wrap 342 and the bottom surface of the recess 331 of the fixed scroll 330, respectively (see FIG. 15). Therefore, during an ordinary operation of the compressor 301, there is the lubricating oil L discharged from the outlet hole 308*c* of the shaft 308 in the axial directional gaps D3, D4 (illustration omitted, see FIG. 5 (*a*) of first embodiment).

Further, as hereinabove described, the radial-directional gap d2 is formed in a plurality of parts between the side surface of the moveable-side wrap 342, the side surface of the fixed-side wrap 332, and the circumferential wall of the recess 331 (see FIG. 15). Therefore, during an ordinary operation of the compressor 301, there is the lubricating oil L discharged from the outlet hole 308*c* of the shaft 308 in the radial-directional gap d2.

However, depending on the operation conditions of the compressor 301, there may be a difference in the amount of thermal expansion between the fixed scroll 330 and the moveable scroll 340, or the fixed scroll 330 or the moveable scroll 340 may be deformed by the pressure from the high-pressure refrigerant, which may lead to a problem that the axial directional gaps D3, D4 or the radial-directional gap d2 close (s) up.

Continuous operation of the compressor 301 may cause the resin layers 346*a* to 346*d* to swell by absorbing the lubricating oil L or the refrigerant. Thus, even during an ordinary operation, the axial directional gaps D3, D4 or the radial-directional gap d2 may close up.

The slidability of the resin layers 346*a* to 346*d* however prevents the seizure, even when the axial directional gaps D3, D4 or the radial-directional gap d2 close (s) up as is described hereinabove.

Further, in the present embodiment, the arithmetic mean surface roughness Ra of the surfaces of the resin layers 346*a* to 346*d* is 0.3 or higher and is relatively rough. Thus, when the surfaces of the resin layers 346*a* to 346*d* slides in contact with another member, the minute protrusions constituting the surface roughness of the resin layers 346*a* to 346*d* are easily worn out or at least easily deformed. This reduces the surface pressure between the contact surfaces, thus reducing the frictional loss. Thus, the efficiency of the compressor 1 is kept from being deteriorated.

The effects brought about by kurtosis Rku of the roughness curve of the surfaces of the resin layers 346*a* to 346*d* being 3 or more, the effects brought about by the skewness Rsk of the roughness curve of the surfaces of the resin layers 346*a* to 346*d* being more than 0, and the effects brought about by the maximum height roughness Rz being more than the average length RSm of the roughness curve element are the same as those obtained by First Embodiment.

<Fifth Embodiment>

The following describes a fifth embodiment of the present invention.

The compressor of the present embodiment is a mono cylinder rotary compressor which is almost similar to that of First Embodiment, and is different from First Embodiment in the structures of the surfaces of the piston and the front head. The structure other than the above is the same as that of First Embodiment. Therefore, the same reference numerals are given and the explanations are omitted as needed.

Figure 16:
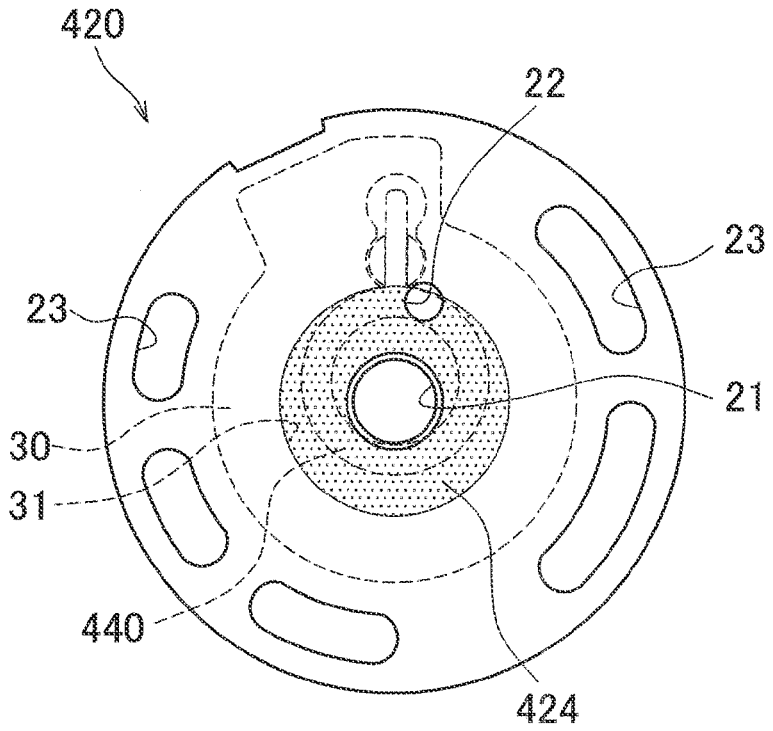
FIG. 16 is a diagram providing a bottom view of the front head in a compressor related to a fifth embodiment of the present invention.
Figure 18A:
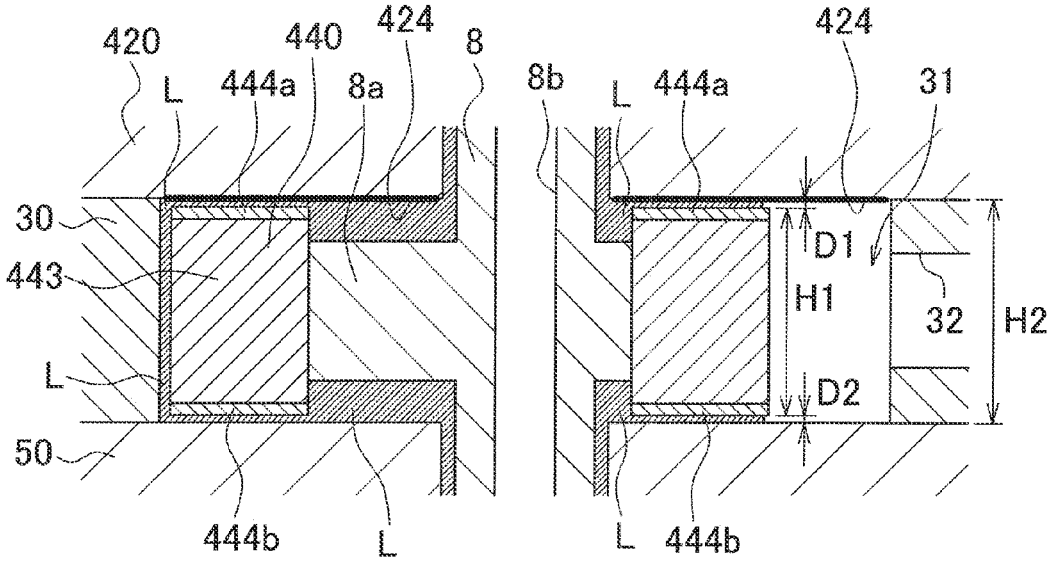
FIG. 18 is a schematic diagram providing partially enlarged views of the compressor related to Fifth Embodiment of the present invention, wherein FIG. 18 (*a*) shows a state where the resin layer is not swollen and FIG. 18 (*b*) shows a state where the resin layer is swollen.
Figure 18B:
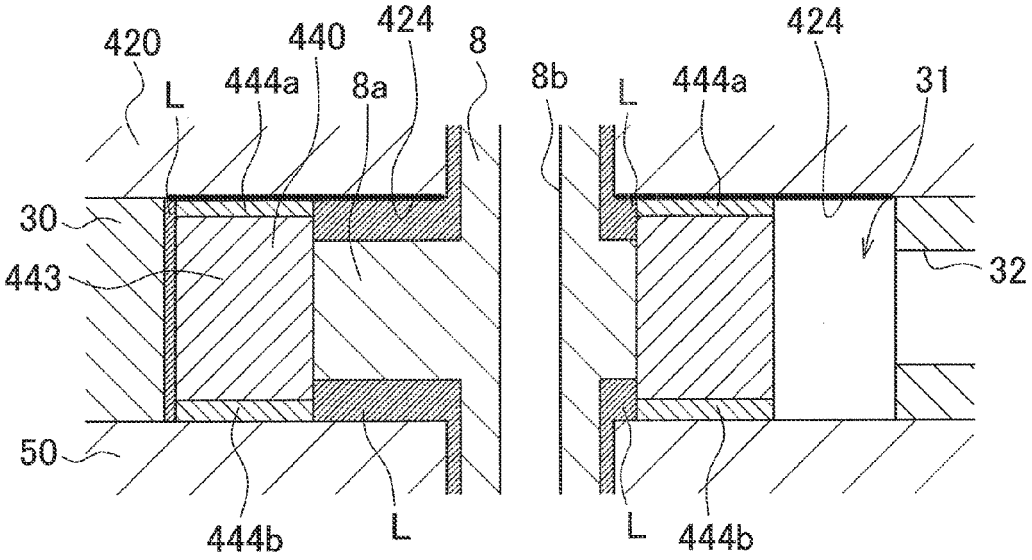

As shown in FIG. 16 and FIG. 18, a front head 420 of the present embodiment has a rough surface portion 424 where the surface roughness is rough, in a portion of the under surface of the front head 420 which overlaps the compression chamber 31, when viewed in the vertical direction. In FIG. 18, the rough surf ace portion 424 is shown by a bald line. The arithmetic mean surface roughness Ra of the rough surface portion 424 is, for example, 0.3 or higher and is preferably approximately 0.5. Note that the arithmetic mean surface roughness Ra complies with JIS B0601:2001.

The minute recesses and protrusions on the rough surface portion 424 are formed by chemical processing, cutting by using a specialized tool, or by means of laser application, after the process of polishing. Note that it is possible to omit the polishing process, and the minute recesses and protrusions on the surface formed by sintering, casting, or cutting may be utilized as the rough surface portion 424.

The arithmetic mean, surface roughness Ra of the top surface of the rear head 50 is, for example, less than 0.3.

FIG. 18(*a*) shows the compressor at the time of shipment. As shown in FIG. 18(*a*), the vertical length H1 of the piston 440 at the time of shipment is slightly smaller than the vertical length H2 of the compression chamber 31, and the difference is, for example, 5 to 15 μm.

Figure 17:
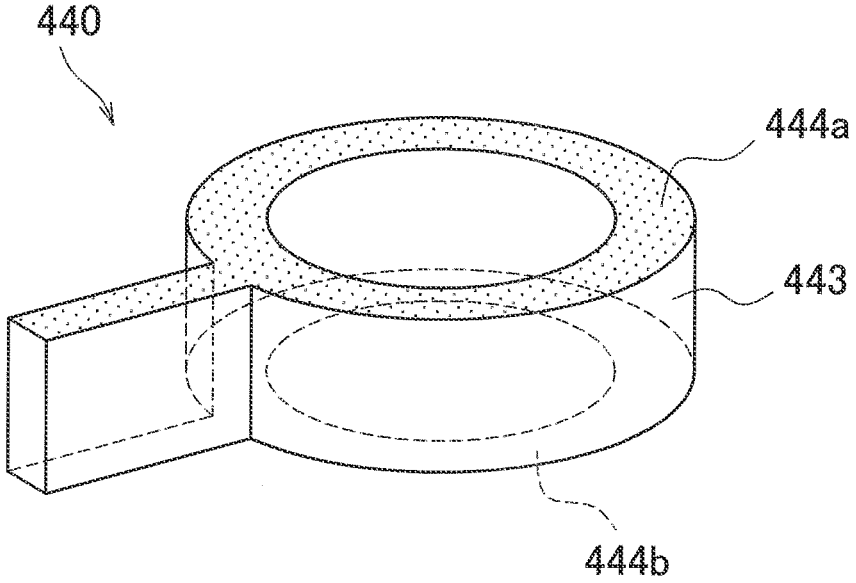
FIG. 17 is a perspective diagram of a piston of a compressor related to a fifth embodiment of the present invention.

As shown in FIG. 17 and FIG. 18 (*a*), the piston 440 of the present, embodiment includes a base 443 made of a metal material, and resin layers 444*a*, 444*b* which are thin films covering the surfaces of the base 443.

The resin layers 444*a*, 444*b* covers the top and under surfaces of the base 443, respectively. In other words, the resin layers 444*a*, 444*b* are formed on the upper and lower end surfaces of the piston 440, respectively. The material of the resin layers 444*a*, 444*b* is the same as that of the resin layers 44*a*, 44*b* of First Embodiment. The surfaces of the resin layers 444*a*, 444*b* are substantially flat. The resin layers 444*a*, 444*b* are formed by applying and drying a solution of a resin composition several times on the surfaces of the base 443. The film thickness of each of the resin layers 444*a*, 444*b* at the time of shipment of the compressor is, for example, approximately 10 to 20 μm.

The compressor of the present embodiment, with the resin layers 444*a*, 444*b* on the upper and lower end surfaces of the piston 440, respectively, is able to prevent the seizure with the slidability of the resin layers, even when the axial directional gaps D1, D2 close up as shown in FIG. 18(*b*) due to thermal expansion of the piston 440 and swelling of the resin layers 444*a*, 444 *b*.

Further, in the present embodiment, the resin layer 444*a* provided on the upper end surface of the piston 440 opposes the rough surface portion 424 of the front head 420. The rough surface portion 424 is harder than the resin layer 444*a* and its surface roughness is greater than that of the resin layer 444*a*. Therefore, when the rough surface portion 424 and the resin layer 444*b* contact each other and slide, the minute protrusions formed on the rough surface portion 424 wears out the surface of the resin layer 444*a* to the extent that there is almost no surface pressure. As such, the surface pressure between the contact surfaces is reduced, thus reducing the frictional loss. It is therefore possible to restrain deterioration in the efficiency of the compressor. Note that the resin layer 444*a* does not necessarily have to be worn out to the extent that there is almost no surface pressure. The effect of reducing the frictional loss is also brought about by having the resin layer 444*a* worn out to the extent that the surface pressure is reduced.

Further, in the compressor of the present embodiment, the axial direction of the compression chamber 31 corresponds to the vertical direction. Therefore, due to the gravity of the piston 440, the lower end surface of the piston 440 and the top surface of the rear head 50 are brought into contact with each other relatively easily. When the surface roughness of the surface opposing to the upper end surface of the piston 440 of the front head 420 is the same as that of the surface opposing to the lower end surface of the piston 440 of the rear head 50, the resin layer 444*b* on the lower end surface of the piston 440 is more easily worn out than the resin layer 444*a* on the upper end surface of the piston 440. Since the surface roughness of the under surface of the front head 420 is greater than that of the top surface of the rear head 50 in the present embodiment, the resin layer 444*b* on the lower end surface of the piston 440 is kept from being worn out more than the resin layer 444*a* on the upper end surface of the piston 440.

<Sixth Embodiment>

Next, the following describes a sixth embodiment of the present invention.

A compressor of the present embodiment is a dual-cylinder rotary compressor which is substantially similar to that of Second Embodiment, and is different from Second Embodiment in the structures of the two pistons, the front head, and the surfaces of the middle plate. The other structures are the same as Second Embodiment, and therefore the same reference numerals are given to those structures and the explanations are therefore omitted as needed.

Figure 19:
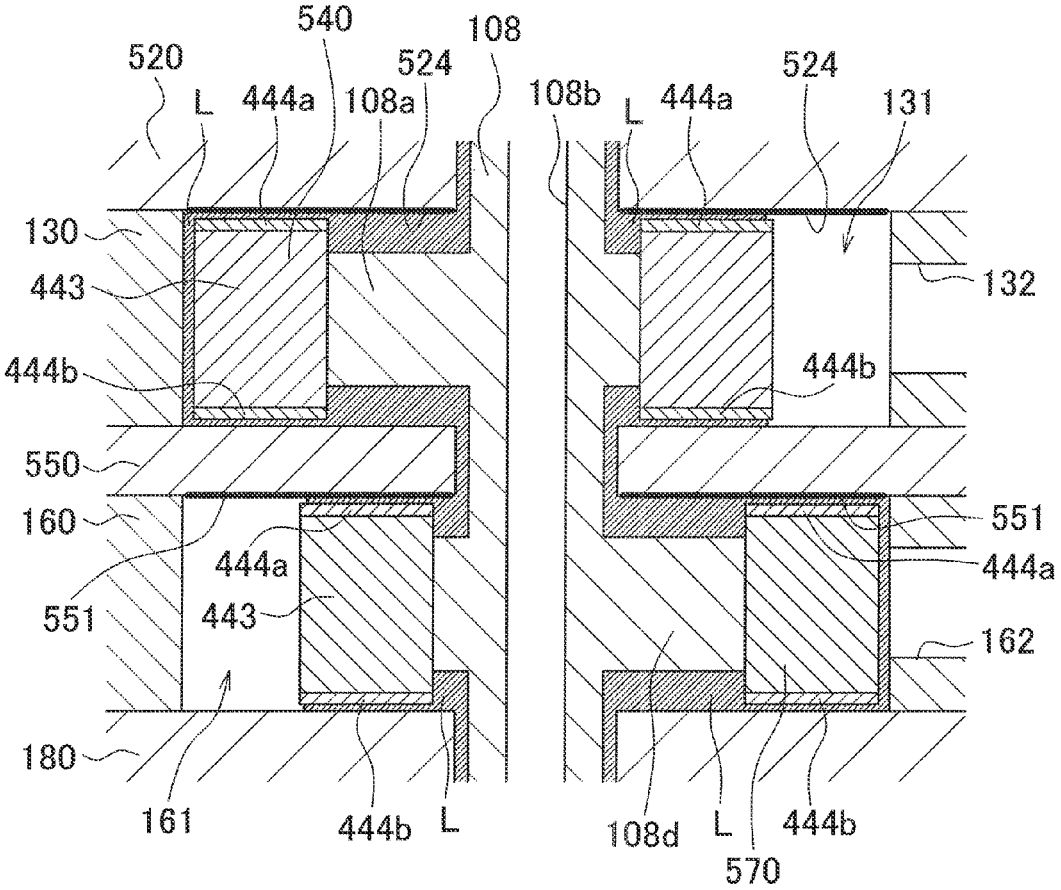
FIG. 19 is a schematic diagram providing a partially enlarged view of the compressor related to a sixth embodiment of the present invention.

As shown in FIG. 19, a front head 520 of the present embodiment has a rough surface portion 524 whose surface roughness is similar to that of the rough surface portion 424 in Fifth Embodiment. The rough, surface portion 524 is formed in a portion of the under surface of the front head 520 which overlaps the compression chamber 131 of the cylinder 130, when viewed in the vertical direction. Further, a middle plate 550 of the present embodiment has a rough surface portion 551 whose surface roughness is similar to that of the rough surface portion 524, in a portion of the under surface overlapping the compression chamber 161 of the cylinder 160, when viewed in the vertical direction.

Further, the arithmetic mean surface roughness Ra of the top surface of the middle plate 550 and that of the top surface of the rear head 180 are, for example, less than 0.3.

Each of the two pistons 540, 570 of the present embodiment includes a base 443 made of a metal material and resin layers 444*a*, 444*b* which are thin films covering the surfaces of the base 443, as in the case of the piston 440 of Fifth Embodiment.

As in fifth embodiment, in the compressor of the present embodiment, each of the pistons 540, 570 has the resin layers 444*a*, 444*b* on its upper and lower end surfaces. Rough surface portions 524, 551 are provided to portions opposing to the resin layers 444*a* on the upper end surfaces of each of the pistons 540, 570. This brings about the effects similar to those brought about by Fifth Embodiment.

<Seventh Embodiment>

Next, the following describes a seventh embodiment of the present invention.

A compressor of the present embodiment is a mono cylinder rotary compressor substantially similar to that of Third Embodiment, and is different from Third Embodiment in the structures of the roller, the vane, and the surface of the front head. The other structures are the same as those of Third Embodiment. Therefore, the same reference numerals are given to those structures and the explanations are omitted as needed.

A front head of the present embodiment has a structure similar to that of the front head 420 in Fifth Embodiment, and has a rough surface portion 424 on its under surface.

Figure 20:
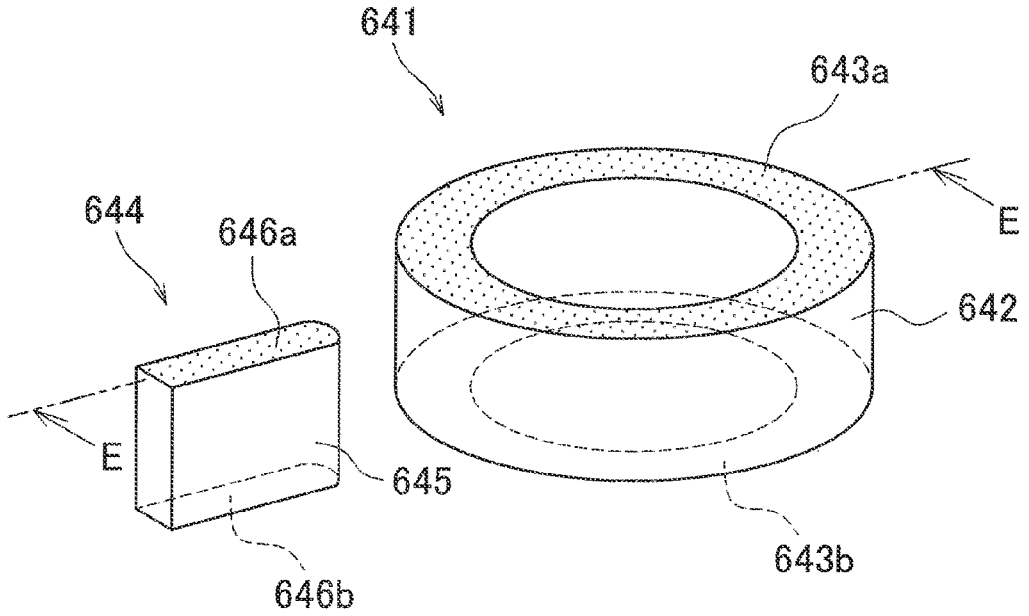
FIG. 20 is a perspective diagram of a roller and a vane in a compressor of a seventh embodiment of the present invention.
Figure 21:
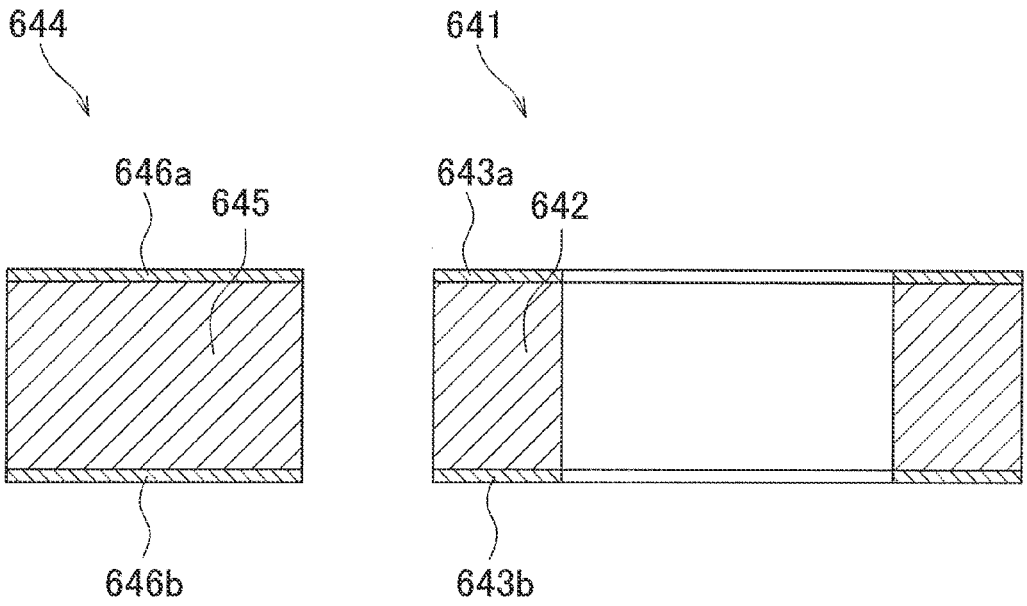
FIG. 21 is a cross sectional view taken along the line E-E in FIG. 20.

As shown in FIG. 20 and FIG. 21, the roller 641 of the present embodiment includes a base 642 made of a metal material and resin layers 643*a*, 643*b* which are thin films covering the surfaces of the base 642. Further, the vane 644 of the present embodiment includes a base 645 made of a metal material, and resin layers 646*a*, 646*b* which are thin, films covering the surfaces of the base 645.

The resin layers 643*a*, 643*b* on the roller 641 cover the top and under surfaces of the base 642, respectively. In other words, the resin layers 643*a*, 643*b* are formed on the upper and lower end surfaces of the roller 641, respectively. Further, the resin layers 646*a*, 646*b* on the vane 644 are formed on the top and under surfaces of the base 645, respectively. In other words, the resin layers 646*a*, 646*b* are formed, on the upper and lower end surfaces of the vane 644, respectively. The material, the film thickness, and the surface shape of the resin layers 643*a*, 643*b*, 646*a*, and 646*b* are the same as those of the resin layers 444*a*, 444*b* on the piston 440 in Fifth Embodiment.

The compressor of the present embodiment, with the resin layers 643*a*, 643*b*, 646*a*, 646*b* on its upper and lower end surfaces of the roller 641 and on its upper and lower end surfaces of the vane 644, is able to prevent seizure taking place when the axial directional gap closes up.

Further, the rough, surface portion 424 is formed in portions opposing to the resin layers 643*a*, 646*a* on the upper end surfaces of the roller 641 and the vane 644. Therefore, when the resin layers 643*a*, 646*a* contact the rough surface portion 424 and slide, the resin layers 643*a*, 646*a* are worn off, thus reducing the frictional loss.

Thus, embodiments of the present invention are described hereinabove. However, the specific structure of the present invention shall not be interpreted as to be limited, to the above described First to Seventh Embodiments. The scope of the present invention is defined not by the above embodiments but by claims set forth below, and shall encompass the equivalents in the meaning of the claims and every modification within the scope of the claims. The modifications described below may be implemented in combination as needed.

Figure 22:
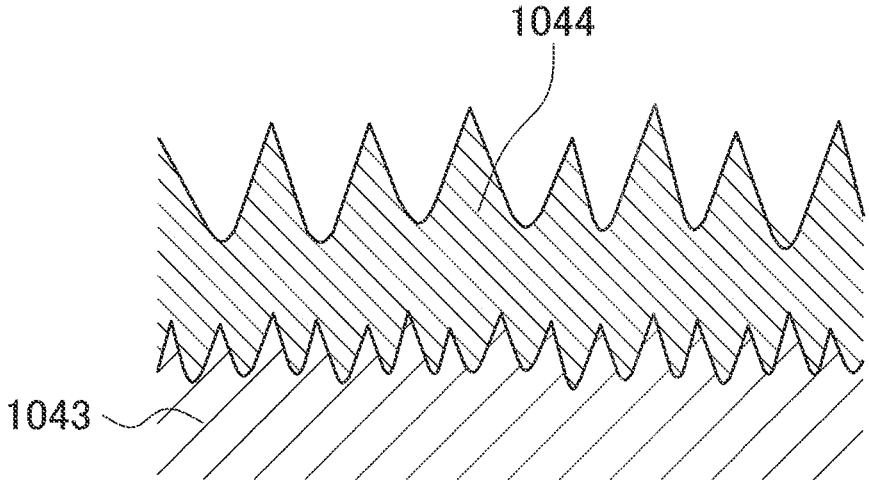
FIG. 22 is an enlarged view schematically illustrating a cross section of the resin layer and a base of another embodiment of the present invention.
Figure 23:
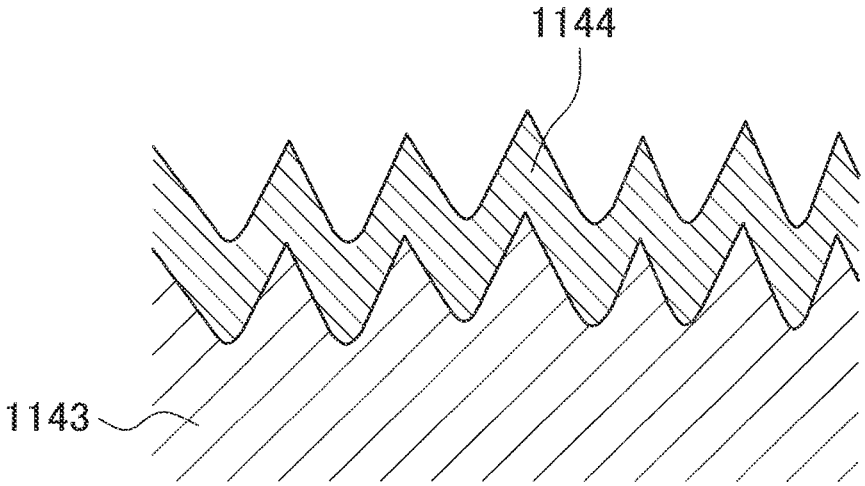
FIG. 23 is an enlarged view schematically illustrating a cross section of the resin layer and a base of yet another embodiment of the present invention.

The first to Third Embodiment deal with a case where the surface of the base on which the resin layer is formed is made flat by polishing process; however, for example, as shown in FIG. 22 and FIG. 23, it is possible to form, minute protrusions and recesses on surfaces of bases 1043, 1143 on which resin layers 1044, 1144 are formed, respectively. Specifically, the arithmetic mean surface roughness Ra of the surfaces of the bases 1043, 1143 is preferably, for example, 0.3 or more. This structure results in a good adhesiveness of the resin layers 1044, 1144 on to the bases 1043, 1143, and the resin layers are hardly peeled off.

Note that the minute protrusions and recesses on the surfaces of the bases 1043, 1143 are formed, surface roughening process involving a chemical treatment, cutting by using a specialized tool, laser application, or the like.

Further, the above embodiments deal with a case where the surface of the base is subjected to the polishing process, after forming the base by sintering, casting, or cutting; however, this polishing process may be omitted and the minute recesses and protrusions formed on the surface in sintering or the like may be used as they are.

Further, in the above mentioned modification, the recesses and protrusions constituting the surface roughness of the resin layer 1144 may be formed so as to correspond to the recesses and protrusions formed on the surface of the base 1143, as shown in FIG. 23. This structure enables formation of the resin layer 1144 simply by resin coating on the base 1143, without a process for forming the recesses and protrusions on the resin layer.

Figure 24:
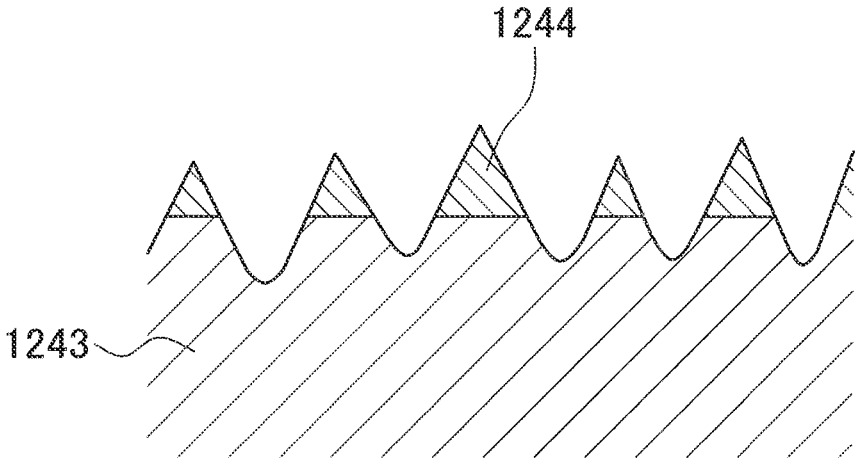
FIG. 24 is an enlarged view schematically illustrating a cross section of the resin layer and a base of yet another embodiment of the present invention.

The above described First to Third Embodiments deal with a case where the recesses and protrusions constituting the surface roughness of the resin layers are only formed on the resin layers; however, as shown in FIG. 24, the recesses and protrusions constituting the surface roughness of the resin layer 1244 may be formed on the resin layer 1244 and the base 1243.

The resin layers of the above embodiments are only formed by a resin composition, and therefore are easily deformed at the time of sliding. In this regard therefore, the resin layers of the above embodiments are preferable.

The above described First and Second Embodiments deal with a case where the resin layer 44*a* with roughened surface is provided throughout the upper end surface of the piston, however, the resin layer 44*a* may be provided to a portion of the upper end surface of the piston. In such a case, the resin layer does not have to be provided, to the rest of the upper end surface of the piston. Alternatively, a resin layer with substantially flat surface, which is not roughened, may be entirely or partially provided to the rest of the portion of the upper end surface.

Figure 25:
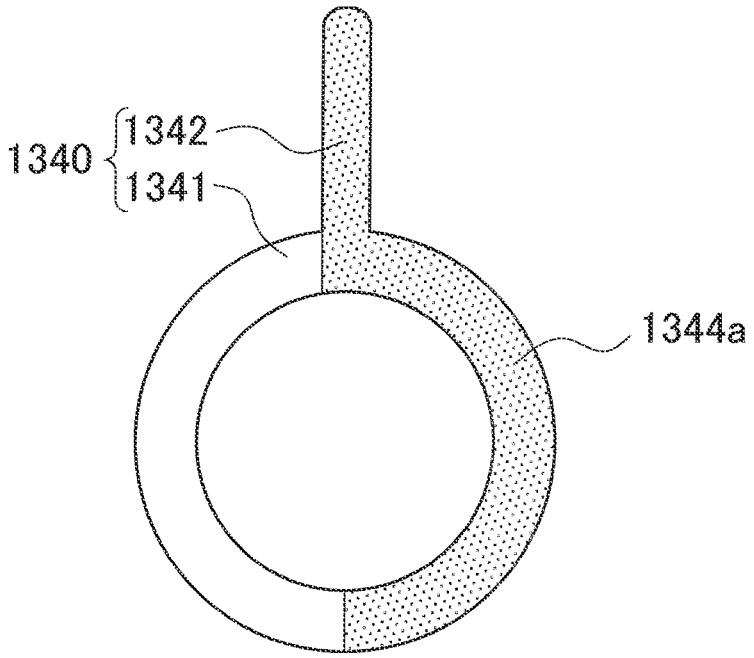
FIG. 25 is a plan view of a piston of another embodiment of the present invention.

Giving an example of the former case, as in the case of the piston 1340 shown in FIG. 25, it is possible to provide the roughened resin layer 1344*a* to the upper end surface of the blade 1342 and substantially a half of the upper end surface of the roller 1341, on the side of the draw-in hole 32 from the blade 1342 (i.e., substantially the right half in FIG. 25), and provide no resin layer to the rest of the upper end surface of the piston 1340. This structure, although the range for preventing the seizure is reduced, enables reduction of the axial directional gap as much as possible on the side of the low pressure chamber 31*a* by the resin layer 1344*a*. Therefore, the high-temperature lubricating oil L from the outer periphery of the shaft 8 is restrained from entering the low pressure chamber 31*a*. This restrains heating of the refrigerant in the low pressure chamber 31*a* which leads to the problem of deterioration in the compression efficiency.

Figure 26:
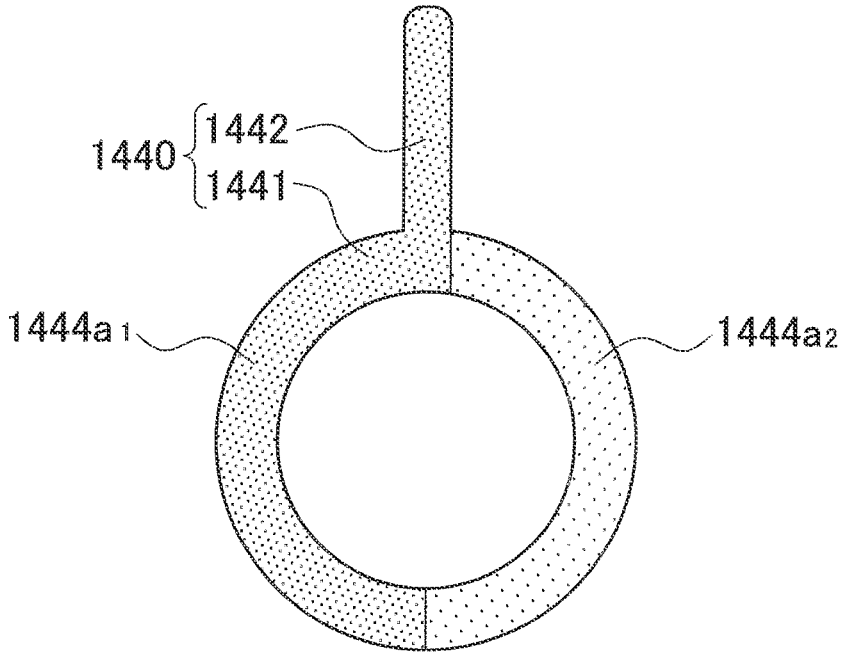
FIG. 26 is a plan view of a piston of another embodiment of the present invention.

Giving an example of the latter case, as in the case of the piston 1440 shown in FIG. 26, it is possible to provide a roughened, resin layer 1444$a_1$ to the upper end surface of the blade 1442 and substantially a half of the upper end surface of the roller 1441, on the side of the discharge hole 22 from the blade 1442 (i.e., substantially the left half in FIG. 26), and provide a substantially flat and not-roughened resin layer 1444$a_2$ to substantially a half of the upper end surface of the roller 1441, on the side of the draw-in hole 32 from the blade 1442 (right side of FIG. 26). In this case, the thickness of the roughened resin layer 1444$a_1$ is less than the not-roughened resin layer 1444$a_2$. Substantially the left half of the piston 1440 in FIG. 26 is heated by the high-pressure, high-temperature refrigerant in the high pressure chamber 31*b*, and the amount of thermal expansion is greater than substantially the right half of the piston 1440 in FIG. 26. Accordingly, substantially the left half of the upper end surface of the piston 1440 in FIG. 26 easily contacts the front head 20. Roughening only the resin layer 1444$a_1$ formed on this easily-contacting portion reduces the work required for roughening, while effectively reducing the surface pressure between the contact surfaces.

Further, the same goes to the resin layers 44*b*, 44*c* of First and Second Embodiments and the resin layers 243*a* to 243*c*, 246*a*, 246*b* of Third Embodiment, and the resin layers 346*a* to 346*d* of Fourth Embodiment. Each of these resin layers does not have to be formed on the entire corresponding surface and may be provided only a part of the corresponding surface, as in the case of the resin layer 44*a*.

The above described First and Second Embodiments deal with a case where the three roughened resin layers 44*a* to 44*c* are provided to the piston; however, it is not necessary to provide all of these three resin layers. Further, as long as the surface of at least one of the three resin layers is roughened, the surfaces of the rest of the resin layers do not have to be roughed and may be substantially flat.

The same goes for the resin layers 243*a* to 243*c*, 246*a*, 246*b* of Third Embodiment, and for the resin layers 346*a* to 346*d* of Fourth Embodiment.

Fourth Embodiment deals with a case where the resin layer 346*b* is provided to a portion of the top surface of the flat plate section 341 of the moveable scroll 340, which portion opposing to the bottom surface of the recess 331; however, the resin layer may be provided to the other parts of the top surface of the flat plate section 341. The surface of this resin, layer does not have to be roughened.

The above described First and Second Embodiments deal with a case where the resin layers 44*a* to 44*c* are provided to the upper and lower end surfaces of the piston, and the outer circumference surface of the roller 41; however, the resin layer may be provided to the surfaces other than the above surfaces of the piston (e.g., the side surface of the blade 42, the circumferential wall of the compression chamber 31). The surface of this resin layer does not have to be roughened. The same goes to the roller 241 and the vane 244 of Third Embodiment, and the moveable scroll 340 of Fourth Embodiment.

The above described First to Fourth Embodiments deal with a case where the roughened resin layer is provided to one of two surfaces constituting the axial directional gap; however, the roughened, resin layer may be provided to the other surface, instead of providing the resin layer to that one of the two surfaces.

For example, instead of providing the resin layer 44*a* to the upper end surface of the piston 40(140), the roughened resin layer may be provided to the under surface of the front head 20 (120).

When the resin layer is provided to the under surface of the front head, the resin layer may be provided to an area of the under surface overlapping the compression chamber 31 when viewed in the vertical direction (see the area of the rough surface portion 424 in FIG. 16). Alternatively, the resin layer may be provided throughout the entire under surface. The same goes to the cases where the resin layer is provided, to the rear head and the middle plate.

The above described First to Fourth Embodiments deal with a case where the resin layer is provided to one of two surfaces constituting the axial directional gap; however, the resin layer may be provided to the both of two surfaces constituting the axial directional gap. In this case, the both resin layers may be a roughened resin layer. Alternatively, only one of the resin layers may be a roughened resin layer, and the other resin layer may be substantially flat resin layer whose surface is not roughened.

The above described First to Fourth Embodiments deal with a case where the roughened resin layer is provided to one of two surfaces constituting the radial-directional gap; however, the roughened resin layer may be provided to the other surface, instead of providing it to that one of the two surfaces. For example, instead of providing the resin layer 346*d* to the inner circumference surface of the moveable-side wrap 342, the resin layer 346*d* may be provided to the outer circumference surface of the fixed-side wrap 332.

The above described First to Fourth Embodiments deal with a case where the resin layer is provided to one of the two surfaces constituting the radial-directional gap; however, the resin layer may be provided to the both of the surfaces constituting the radial-directional gap. In this case, the both resin layers may be a roughened resin layer. Alternatively, only one of the resin layers may be a roughened resin layer, and the other resin layer may be substantially flat resin layer whose surface is not roughened.

The above described Fifth and Sixth Embodiments deal with a case where the resin layer 444*a* is provided to the entire upper end surface of the piston; however, the resin layer 444*a* may be provided only to a part of the upper end surface of the piston. For example, of the upper end surface of the piston, it is possible to provide the resin layer may be provided only to the upper end surface of the blade, and substantially a half of the upper end surface of the roller, on the side of the draw-in hole 32 from the blade (see resin layer 1344*a* of FIG. 25), and provide no resin layer to the rest of the upper end surface of the piston. This structure, although the range for preventing the seizure is reduced, enables reduction of the axial directional gap as much, as possible on the side of the low pressure chamber 31*a* by the resin layer. Therefore, the high-temperature lubricating oil L from the outer periphery of the shaft 8 is restrained from entering the low pressure chamber 31*a*. This restrains heating of the refrigerant in the low pressure chamber 31*a* which leads to the problem, of deterioration in the compression efficiency.

Further, the same goes for the resin layer 444*b* of the Fifth and Sixth Embodiments and the resin layers 643*a*, 643*b*, 646*a*, 646*b* of Seventh Embodiment. Each of these layers does not have to be formed on the entire corresponding surface and may be provided only a part of the corresponding surface.

The resin layer 444*b* on the lower end surface of each of the pistons 440, 540, 570 in fifth and sixth embodiment does not necessarily have to be provided. Further, the resin layer 643*b* on the lower end surface of the roller 641 and the resin layer 646*b* on the lower end surface of the vane 644 in Seventh Embodiment do not necessarily have to be provided.

The above described Fifth to Seventh Embodiments deal with a case where the rough surface portions 424, 524 are each provided to the entire portion of the under surface of the front head, which portion overlaps the compression chamber when viewed in the vertical direction. However, the rough surface portion may be provided only to a part of the portion which overlaps the compression chamber.

Figure 27:
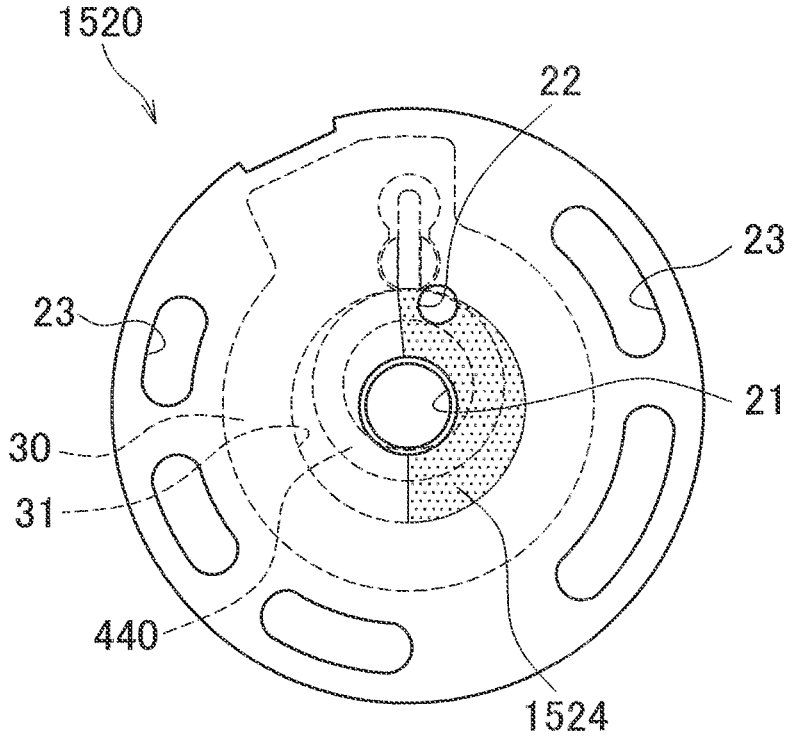
FIG. 27 is a diagram providing a bottom view of the front head of another embodiment of the present invention.

For example, as shown in FIG. 27, of the portion of the under surface of the front head 1520 which overlaps the compression chamber 31 when viewed in the vertical direction, it is possible to form a rough surface portion 1524 on substantially a half of the portion on the side of the high pressure chamber 31*b* (right side of FIG. 27). Substantially a half of the piston 440 on the side of the high pressure chamber 31*b* (right side of FIG. 27) is heated by the high-temperature, high-pressure refrigerant in the high pressure chamber 31*b*. As such, the amount of thermal expansion is greater than that on substantially another half of the piston 440 on the side of the low pressure chamber 31*a*. Therefore, substantially the right half of the upper end surface of the piston 440 in FIG. 27 therefore is more likely to contact the under surface of the front head 1520. This modification however forms the rough surface portion 1524 only the part of the under surface of the front head 1520, which part easily contacts the resin layer 444*a* on the upper end surface of the piston 440. This reduces the work for roughening the surface, while effectively reducing the surface pressure between the contact surfaces. The same goes for the rough surface portion 551 on the under surface of the middle plate 550 in seventh embodiment.

The above described Fifth to Seventh Embodiments deal with a case where the rough surface portions 424, 524 are each formed in a part of the under surface of the front head, which portion overlaps the compression chamber, when viewed in the vertical direction. However, the entire under surface of the front head may be rough.

The same goes for the under surface of the middle plate 550 of Seventh Embodiment.

The above described Fifth Embodiment deals with a case where the resin layer 444*a* is provided to the upper end surface of the piston 440, and where the under surface of the front head 420 opposing to this resin layer 444*a* is made rough. However, it is possible to make the surface of the upper end surface of the piston rough, without providing the resin layer, and provide the resin layer on the under surface of the front head. The resin layer on the under surface of the front head may be provided throughout the entire under surface, or a part of the under surface (e.g., a part that overlaps the compression chamber 31, when viewed in the vertical direction). The same goes for the upper end surface of the piston 540 and the under surface of the front head 520, the upper end surface of the piston 570 and the under surface of the middle plate 550 in Sixth Embodiment, the upper end surfaces of the roller 641 and the vane 644, and under surface of the front head 420 in Seventh Embodiment. The resin layer and the rough surface portion may be other way around.

Fifth Embodiment deals with a case where the resin layer 444*b* is provided to the lower end surface of the piston 440; however, a resin layer may be provided to the top surface of the rear head 50 instead of providing the resin layer to the lower end surface of the piston 440. Further, the resin layer may be provided to both the lower end surface of the piston 440 and the top surface of the rear head 50. Note that the resin layer on the top surface of the rear head 50 may be provided to the entire top surface or to a part (e.g., a part overlapping the compression chamber 31, when viewed in the vertical direction). The same goes for the lower end surface of the piston 540, the top surface of the middle plate 550, the lower end surface of the piston 570, and the top surface of the rear head 180 in sixth embodiment, and the lower end surface of the roller 641 and the vane 644, and the under surface of the rear head 50 in seventh embodiment. The resin layer may be provided to the surface on the opposite side or to the both surfaces.

In the above fifth embodiment, the surface opposing to the upper end surface of the piston 440 (resin layer 444*a*) is made rough and the surface opposing to the lower end surface of the piston 440 (resin layer 444*b*) is made substantially flat. This however may be other way around, and the surface opposing to the upper end surface of the piston 440 may be substantially flat and the surface opposing to the lower end surface of the piston 440 may be rough. That is, the under surface of the front head may be substantially flat, and the top surface of the rear head may be rough entirely or partially (e.g., a part overlapping the compression chamber 31, when viewed in the vertical direction).

Note however that in cases where the compressor is disposed so that the axial direction of its shaft 8 is in the vertical direction (or any other directions other than the vertical direction, which is tilted with respect to a horizontal direction), the lower end surface of the piston and the top surface of the rear head are easily brought into contact due to the gravity working on the piston. Therefore, the resin layer may be worn out more easily on the top surface of the rear head, depending on the surface roughness. For this reason, it is preferable that the under surface of the front head be made rough and the top surface of the rear head be made substantially flat, as in the case of Fifth Embodiment. The same goes for the under surface of the front head 520, the top surface of the middle plate 550, the under surface of the middle plate 550, the top surface of the rear head 180 in Sixth Embodiment, and the front head 420 and the rear head 50 in Seventh Embodiment. The rough surface may be formed on the opposite side.

The above fifth embodiment deals with a case where the surface opposing to the upper end surface of the piston 440 (resin layer 444*a*) is made rough and the surface opposing to the lower end surface of the piston 440 (resin layer 444*b*) is made substantially flat. However, the surface opposing to the upper end surface of the piston 440 (resin layer 444*a*) and the surface opposing to the lower end surface of the piston 440 (resin layer 444*b*) may be both rough. That is, the under surface of the front head and the top surface of the rear head may be rough entirely or partially (e.g., apart overlapping the compression chamber 31 in FIG. 16, when, viewed, in the vertical direction). In this case, the surface roughness of the under surface of the front head and that of the top surface of the rear head may be the same or be different from each other. To prevent an excessive wear of the resin layer, the top surface of the rear head is preferably not as rough as the under surface of the front head.

The same goes for the under surface of the front head 520, the top surface of the middle plate 550, the under surface of the middle plate 550, and the top surface of the rear head 180 in sixth embodiment, and the front head 420 and the rear head 50 in seventh embodiment. The both surfaces may be rough.

The above fifth embodiment deals with a case where the compressor is disposed so that the axial direction of its shaft 8 is in the vertical direction; however, the compressor may be disposed so that the axial direction of its shaft 8 is tilted with respect to the vertical direction, or that the axial direction of the shaft 8 is in a horizontal direction. In the latter case, the gravity works in radial directions of the piston 440. Therefore, no matter which one of the front head 420 and the rear head 50 the rough surface portion is formed, the resin layers 444*a*, 444*b* are both worn by substantially the same amount. For this reason, the rough surface portion may be formed on the front head 420 or on the rear head 50, or on both of the front head 420 and the rear head 50.

The same goes to the compressors of Sixth and Seventh Embodiments.

The above described First to Third Embodiments, and Fifth to Seventh Embodiments deal with a case where the compressing structure is supported by the outer periphery of the front head being fixed to the inner circumference surface of the closed casing 2; however, the compressing structure may be supported by the outer periphery of the cylinder, the middle plate, or the rear head being fixed to the inner circumference surface of the closed casing 2.

The above described Third Embodiment and Seventh Embodiment deal with a case where a compressing structure having a roller and a vane is applied to a mono cylinder rotary compressor; however, such a compressing structure may be adopted to a dual-cylinder rotary compressor.

The above described Fourth Embodiment deals with a case where the fixed scroll 330 in the compressor 301 includes the recess 331, and the moveable scroll 340 includes the flat plate section. 341. However, it is possible that the moveable scroll 340 has the recess and the fixed scroll 330 has the flat plate section. In such a case, the moveable scroll corresponds to the first scroll of the present invention and the fixed scroll corresponds to the second scroll of the present invention.

Industrial Applicability

The present invention reduces frictional loss which is caused, by a surface of a resin layer sliding while contacting another member opposing to the resin layer.

What is claimed is:

1. A compressor, comprising:

sliding members arranged to slide relative to each other when compressing a refrigerant, at least one of the sliding members including a resin layer formed on a whole area or a portion of at least one sliding surface thereof, an arithmetic mean surface roughness of the resin layer being 0.3 or higher, and the surface of the resin layer having a skewness of its roughness curves of more than 0, and having a maximum height roughness that is greater than an average length of roughness curve elements.

2. The compressor according to claim 1, further comprising:

a cylinder having a compression chamber and a blade housing in communication with the compression chamber;

a first end plate member and a second end plate member disposed on ends of the cylinder relative to an axial direction; and a piston disposed in the compression chamber and inside the blade housing, the piston including an annular roller disposed in the compression chamber and a blade extending from an outer circumference surface of the roller and disposed in the blade housing so as to be movable forward and backward, the cylinder, the first and second end plate members and the piston being the sliding members, and the at least ne sliding surface having the resin layer formed thereon being at least one of an axial direction end surface of the piston, a surface of the first end plate member opposed to the axial direction end surface of the piston, a surface of the second end plate member opposed to the axial direction end surface of the piston, an outer circumference surface of the roller, and an inner circumference surface of the compression chamber.

3. The compressor according to claim 2, wherein the surface of the resin layer has a kurtosis of its roughness curves of 3 or higher.

4. The compressor according to claim 1, further comprising:

a cylinder having a compression chamber and a vane storage unit in communication with the compression chamber;

a first end plate member and a second end plate member disposed on ends of the cylinder relative to an axial direction;

an annular roller disposed inside the compression chamber; and a vane having a leading end pressed against an outer circumference surface of the roller, the vane being disposed in the vane storage unit so as to be movable forward and backward, the cylinder, the first and second end plate members, the roller and the vane being the sliding members, and the at least one sliding surface having the resin layer formed thereon being at least one of an axial direction end surface of the roller, a surface of the first end plate member opposed to the axial direction end surface of the roller, a surface of the second end plate member opposed to the axial direction end surface of the roller, an axial direction end surface of the vane, an outer circumference surface of the roller, and an inner circumference surface of the compression chamber.

5. The compressor according to claim 4, wherein the surface of the resin layer has a kurtosis of its roughness curves of 3 or higher.

6. The compressor according to claim 1, further comprising:

a first scroll having a recess and a first wrap, the first wrap being spiral shaped and projecting from a bottom surface of the recess; and a second scroll having a flat plate section and a second wrap, the second wrap being spiral shaped and projecting from the flat plate section, the first scroll and the second scroll being closely located relative to each other so that the bottom surface of the recess and the flat plate section oppose each other, and aside surface of the first wrap and a side surface of the second wrap oppose each other, the first scroll and the second scroll being the sliding members, and the at least one sliding surface having the resin layer formed thereon being at least one of an end surface of the first wrap, a surface opposed to the end surface of the first wrap on the flat plate section, an end surface of the second wrap, a surface opposed to the end surface of the second wrap on the bottom surface of the recess, the side surface of the first wrap, the side surface of the second wrap, and an inner circumference surface of the recess.

7. The compressor according to claim 6, wherein the surface of the resin layer has a kurtosis of its roughness curves of 3 or higher.

8. The compressor according to claim 1, wherein the surface of the resin layer has a kurtosis of its roughness curves of 3 or higher.

9. The compressor according to claim 1, wherein recesses and protrusions constituting the surface roughness of the resin layer are formed only on the resin layer.

10. The compressor according claim 1, wherein the surface of the base on which the resin layer is formed has an arithmetic mean surface roughness of 0.3 or higher.

11. The compressor according to claim 10, wherein the recesses and protrusions constituting the surface roughness of the resin layer are formed along recesses and protrusions formed on the surface of the base.

12. The compressor according to claim 1, wherein the hardness of the resin layer is less than the hardness of a surface opposing to the resin layer.

13. The compressor according claim 1, further comprising:

a cylinder having a compression chamber and a blade housing in communication with the compression chamber;

two end plate members disposed on sides of the cylinder relative to the axial direction; and a piston disposed in the compression chamber and inside the blade housing, the piston including an annular roller disposed in the compression chamber and a blade extending from an outer circumference surface of the roller and being disposed in the blade housing so as to be movable forward and backward, the cylinder, the two end plate members and the piston being the sliding members, and the at least one sliding surface having the resin layer being at least one of at least one of axial direction end surfaces of the piston, and a surface of at least one of the end plate members opposed to the at least one of axial direction end surface of the piston;

of the at least one of the axial direction end surfaces of the piston and the surface of the at least one of end plate members opposed to the at least one of axial direction end surfaces of the piston, an area opposed to the resin layer is entirely or partially harder than the resin layer, and has the arithmetic mean surface roughness of 0.3 or higher.

14. The compressor according to claim 1, further comprising:

a cylinder having a compression chamber and a vane storage unit n communication with the compression chamber;

two end plate members disposed on sides of the cylinder relative to the axial direction;

an annular roller disposed inside the compression chamber; and a vane having a leading end pressed against an outer circumference surface of the roller, the vane being disposed in the vane storage unit so as to be movable forward and backward, the cylinder, the two end plate members, the roller and the vane being the sliding members, and the at least one sliding surface having the resin layer is formed thereon being at least one of at least one of axial direction end surfaces of the roller, at least one of axial direction end surfaces of the vane, and a surface of at least one of the end plate members opposed to the at least one of the axial direction end surfaces of the roller or the at least one of the axial direction end surfaces of the vane, of the at least one of the axial direction end surfaces of the roller, the at least one of the axial direction end surfaces of the vane, and the surface of the at least one of end plate members opposed to the at least one of the axial direction end surfaces of the roller or the at least one of the axial direction end surfaces of the vane, an area opposed to the resin layer is entirely or partially harder than the resin layer, and has the arithmetic mean surface roughness Ra of 0.3 or higher.

* * * * *